US005441847A

United States Patent [19]

Fukawa et al.

[11] Patent Number: 5,441,847

[45] Date of Patent: Aug. 15, 1995

[54] METHOD FOR PROCESSING A BLACK-AND-WHITE SILVER HALIDE PHOTOGRAPHIC LIGHT-SENSITIVE MATERIAL

[75] Inventors: Junichi Fukawa; Takeshi Sampei; Kenji Goto, all of Hino, Japan

[73] Assignee: Konica Corporation, Tokyo, Japan

[21] Appl. No.: 249,455

[22] Filed: May 26, 1994

[30] Foreign Application Priority Data

Jun. 10, 1993 [JP] Japan ..... 5-138704

[51] Int. Cl.[6] ..... G03C 5/31

[52] U.S. Cl. ..... 430/264; 430/265; 430/446; 430/488; 430/544; 430/957

[58] Field of Search ..... 430/264, 265, 434, 445, 430/446, 487, 488, 489, 544, 957

[56] References Cited

U.S. PATENT DOCUMENTS

| | | | |
|---|---|---|---|
| 4,668,605 | 5/1987 | Okutsu et al. | 430/267 |
| 5,187,042 | 2/1993 | Katoh et al. | 430/264 |
| 5,221,593 | 6/1993 | Onodera et al. | 430/264 |
| 5,229,248 | 7/1993 | Sampei et al. | 430/264 |
| 5,238,780 | 8/1993 | Takagi et al. | 430/264 |
| 5,262,274 | 11/1993 | Katoh | 430/264 |

FOREIGN PATENT DOCUMENTS

| | | |
|---|---|---|
| 0330109 | 8/1989 | European Pat. Off. . |
| 4-29233 | 1/1992 | Japan . |

OTHER PUBLICATIONS

Patent Abstracts of Japan, vol. 16, No. 197 (1992) of JP-A-04 029 233 (1992).

*Primary Examiner*—Hoa Van Le

*Attorney, Agent, or Firm*—Frishauf, Holtz, Goodman & Woodward

[57] ABSTRACT

A method of processing, by use of an automatic processor, a black-and-white silver halide photographic light-sensitive material containing a hydrazine compound and a redox compound capable of releasing an inhibitor upon oxidation, wherein a developer is replenished by a developer replenisher at a rate of not more than 200 ml per $m^2$ of the photographic material, and the developer has a pH of 9.5 to 10.8. The developer further contains a compound represented by the following formulas [1], [2] or [3].

Z—SM Formula [1]

Formula [2]

Formula [3]

17 Claims, No Drawings

METHOD FOR PROCESSING A BLACK-AND-WHITE SILVER HALIDE PHOTOGRAPHIC LIGHT-SENSITIVE MATERIAL

FIELD OF THE INVENTION

The present invention relates to a method for processing a black-and-white silver halide photographic light-sensitive material having a silver halide light-sensitive layer provided on a support, and more particularly relates to a method for photographically processing a black-and-white silver halide photographic light-sensitive material wherein a high contrast is assured without deteriorating sensitivity and occurrence of black spots and silver sludge is inhibited.

BACKGROUND OF THE INVENTION

A photographic plate-making process comprises a process to convert a document with a continuous tone to a dot image. In this process, an infectious development technology has been used as a photographic technology to reproduce images with a super high contrast.

A lithographic type silver halide photographic light-sensitive material used for infectious development comprises of a silver bromochloride emulsion wherein an average grain size is 0.2 μm, for example, and grain distribution is narrow, a grain has a regular shape, and a silver chloride content is high (50 mol % or more). By processing this lithographic silver halide photographic light-sensitive material with an alkaline hydroquinone developing solution having a low sulfite ion concentration, so-called a lithographic developing solution, an image with a high contrast, a high sharpness and a high resolution can be obtained.

However, since the above lithographic developing solution is liable to be air-oxidized, preservability thereof is not sufficient. Accordingly, it is difficult to keep the quality of development constant in continuous running.

On the other hand, methods to obtain an image with high contrast without using the above lithographic developing solution are known. For example, Japanese Patent Publication Open to Public Inspection No. 106244/1981 (hereinafter referred to as Japanese Patent O.P.I. Publication) discloses a method to incorporate a hydrazine derivative in a silver halide photographic light-sensitive material and to process the light-sensitive material with an alkaline developing solution containing an amino compound. This and other methods make it possible to obtain high contrasted image even when the light-sensitive material is processed with a developing solution having high preservability and capable of processing rapidly. In addition, a method to incorporate a redox compound in a light-sensitive material for improving the quality of dot is disclosed in Japanese Patent O.P.I. Publication No. 285340/1990. In addition, a light-sensitive material having a layer containing a redox compound and a light-sensitive emulsion layer containing a hydrazine derivative for widening dot gradation is disclosed in Japanese Patent O.P.I. Publication No. 174143/1991.

In the above methods, a light-sensitive material had to be processed with a developing solution with pH of more than 11.2 in order to bring out the high contrast property of the hydrazine derivative sufficiently. In a developing solution having a high pH of 11.2 or more, a developing agent is easily oxidized when allowed to stand in contact with air. Though it is more stable than the lithographic developing solution, it is often impossible to obtain an image with high contrast due to the oxidation of the developing agent.

In order to overcome this shortcoming, Japanese Patent O.P.I. Publication No. 29751/1988 and European Patent Nos. 333,435 and 345,025 disclose silver halide photographic light-sensitive materials containing a contrast increasing agent which increases the contrast of light-sensitive material even with a developing solution with comparatively low pH. When using the above methods, stability against air oxidation of a developing solution is noticeably improved compared to the lithographic developing solution. However, it is necessary to add sulfite of 0.25 mol per 1 l to the developing solution for further stabilization.

On the other hand, a black-and-white photographic light-sensitive material for plate-making use is, in most cases, processed by the use of an automatic processing machine after exposure. In addition, it is also ordinary that the above light-sensitive material is processed so that stable photographic performance can be obtained while replenishing a certain amount of developing solution in proportion to the area of the light-sensitive material. Conventionally, in order to obtain above high contrast image, a light-sensitive material has been processed while replenishing a developing solution replenisher in an amount of 300 ml or more per 1 $m^2$ of the light-sensitive material in order to prevent reduction in the ability of a developing solution caused by fatigue or air oxidation of the developing solution in continuous processing.

However, being influenced by recent increased concern about environment, reduction of the amount of the effluent of developing solution has become urgent necessity. When a high contrast light-sensitive material is processed with a developing solution with high sulfite salt concentration in an automatic processing machine under a condition of a small amount of developing solution replenisher of 200 ml or less per 1 $m^2$ of the light-sensitive material, a problem of silver stein, so-called silver sludge, is easily caused. In the case of silver sludge, silver dissolves out of the light-sensitive material and gets into the developing solution and is precipitated on various parts of the automatic processing machine such as rollers and gears to be black or silver-sticking substances so that the surface of the light-sensitive material is contaminated and scratched, deteriorating finished performance. Accordingly, it is important to reduce silver sludge for photographic processing of a high contrast light-sensitive material for plate-making use.

In addition, when the light-sensitive material is processed by an automatic processing machine, the total processing time (dry to dry) from the moment when the leading edge of a film is inserted in the automatic processing machine up to the moment when the trailing edge comes out of the drying zone has hitherto been 90 seconds or more. However, due to the increase of the number of prints and shortening of labor hours, reduction of photographic processing time is demanded. Accordingly, when a high contrast light-sensitive material containing a hydrazine derivative is subjected to rapid processing wherein the total processing time (dry to dry) is less than 60 seconds and subjected to continuous processing in an automatic processing machine under the above-mentioned conditions, silver sludge is easily worsened, photographic processing becomes unstable and sand-like fogging occurring at an unexposed portion after being processed, so-called black spots, which is specific to a light-sensitive material containing the hydrazine derivative easily occurs.

As an silver-sludge-agent ordinarily added to a developing solution, it is conventional to add 2-mercapto-1,3,4-thiazoles (British Patent No. 940,169), 2-mercapto-1,3,4-thiazoles, 1-phenyl-5-mercapto tetrazoles (U.S. Pat. No. 3,173,789), 2-mercaptobenzoxazole and 2-mercaptobenzoimidazole (Photogr. Sci. Eng., 20, 220 (1976)). However, in the case that a hydrazine derivative is added to a light-sensitive material and it is processed with an alkaline developing solution wherein an amino compound is contained, when the above-mentioned anti-silver-sludge agent is used, the effect of preventing sliver sludge was insufficient. In addition, sensitivity reduction and contrast lowering were caused and the effect of preventing black spots was insufficient.

SUMMARY OF THE INVENTION

Against the above-mentioned problems, the object of the present invention is to provide a method for processing a black-and-white silver halide photographic light-sensitive material having a silver halide light-sensitive layer provided on a support, and more particularly relates to a method for photographically processing a black-and-white silver halide photographic light-sensitive material wherein a high contrast is obtained without deteriorating sensitivity and occurrence of black spots and silver sludge is inhibited.

The above-mentioned problems of the present invention are attained by a method for processing a black-and-white photographic light-sensitive material comprising a support provided thereon with at least one of a light-sensitive silver halide emulsion layer and other hydrophilic colloidal layer containing a hydrazine derivative and a redox compound releasing a development inhibitor when oxidized by an automatic processing machine, in which a developer is replenished in an amount of 200 ml or less per 1 $m^2$ of the light-sensitive material, wherein pH of a developing solution is 9.5 to 10.8.

DETAILED DESCRIPTION OF THE INVENTION

In the present invention, pH value of the developing solution is 9.5 to 10.8, in which an image having high contrast and low fog is obtained. The preferable pH value is 10.0 to 10.8.

A preferable embodiment of the present invention is to process a photographic light-sensitive material with a developing solution containing a compound represented by the following Formula [1], Formula [2] or Formula [3].

Z—SM Formula [1]

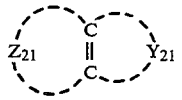

Formula [2]

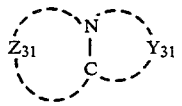

Formula [3]

Next, compounds represented by Formula [1] will be explained.

In the Formula [I], Z represents an alkyl group, an aromatic group or a heterocycle, each of which has at least one selected from a group consisting of a hydroxy group, a $—SO_3M^1$ group, a $—COOM^1$ group (wherein $M^1$ represents a hydrogen atom, an alkaline metal atom or a substituted or unsubstituted ammonium ion), a substituted or unsubstituted amino group and a substituted or unsubstituted ammonio group, or a substituent having at least one selected from the above-mentioned groups; and M represents a hydrogen atom, an alkaline metal atom and a substituted or unsubstituted amizino group (which may form a hydrogen halide salt or a sulfonic acid salt).

A substituent having at least one selected from the above groups is one having 20 or less carbon atoms, and preferably a substituted or unsubstituted alkylthio group, a substituted or unsubstituted alkylamide group, a substituted or unsubstituted alkylcarbamoyl group, a substituted or unsubstituted alkylsulfoneamide group and a substituted or unsubstituted alkylsulfamoyl group.

In addition, in Formula [1], an alkyl group represented by Z is preferably one having 1 to 30 carbon atoms, and it is preferably a straight-chained, branched-chained or a cyclic alkyl group having 2 to 20 carbon atoms. It may have a substituent other than the above-mentioned substituent. An aromatic group represented by Z is preferably a mono-ring or a condensed ring having 6 to 32 carbon atoms. It may have a substituent other than the above-mentioned substituents. A heterocycle represented by Z is preferably a mono-ring or a condensed ring having 1 to 32 carbon atoms. It is a 5-membered or 6-membered ring having 1 to 6 hetero atoms, in a ring independently, selected from nitrogen, oxygen and sulfur. It may have a substituent other than the above-mentioned substituents.

In Formula [1], an ammonio group preferably has 20 or less carbon atoms and as a substituent, it is a substituted or unsubstituted straight-chained, branched-chained or a cyclic alkyl groups (for example, a methyl group, an ethyl group, a benzyl group, an ethoxypropyl group and a cyclohexyl group) and a substituted or unsubstituted phenyl group and a naphthyl group.

Among the compounds represented by Formula [1], especially preferable are those represented by the following Formula [1-a], Formula [1-b] and by Formula [1-c].

These compounds are disclosed in Japanese Patent O.P.I. Publication Nos. 72441/1981, 24347/1981, 122642/1985, 58537/1985 and 29233/1992. However, when these compounds are added to a developing solution and a light-sensitive material containing a hydrazine derivative is developer with the developing solution at a replenishing rate in quantity of 200 ml/l or less effects thereof has not been disclosed.

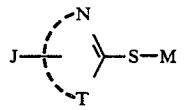

Formula [1-a]

wherein T represents an atomic group necessary for forming a 5-membered or 6-membered heterocycle; J represents a hydroxy group, $—SO_3M^1$, $—COOM^1$ ($M^1$ is the same as $M^1$ in Formula [1]), a substituted or unsubstituted amino group, a substituted or unsubstituted ammonium group; or an alkylthio group having 1 to 19 carbon atoms an alkylamide group having 2 to 18 carbon atoms, an alkylcarbamoyl group having 2 to 18 carbon atoms, an alkyl group having 1 to 19 carbon atoms an aromatic group having 6 to 31 carbon atoms each of which is substituted by one or more of the above-mentioned groups; and M is the same as M in Formula [1].

$A^1$—ALK—$SM^2$ Formula [1-b]

wherein $A^1$ represents a hydroxy group, —$SO_3M^1$, —$COOM^1$ ($M^1$ is the same as $M^1$ in Formula [1]) and —$N(R^3)_2$ group ($R^3$ represents a substituted or unsubstituted alkyl group having 1 to 5 carbon atoms, and $R^3$ and N may be combined to form a ring); ALK represents a substituted or unsubstituted alkylene group having 2 to 12 carbon atoms; $M^2$ represents a hydrogen atom or an alkali metal atom, $$-\overset{\overset{+}{H}N R^4}{\overset{\|}{C}}-NHR^4 \quad X^-$$

($R^4$ represents a hydrogen atom, or a substituted or unsubstituted alkyl group having 1 to 5 carbon atoms; and $X^-$ represents a halide ion or a sulfonic acid ion).

$A_1$—Ar—SM Formula [1-c]

wherein $A^1$ is the same as $A^1$ in Formula [1-b]; Ar represents an arylene group which may be substituted; and M is the same as Formula [1].

Hereunder, practical examples of compounds represented by Formula [1] are shown. However, the present invention is not limited thereto.

(1-1)

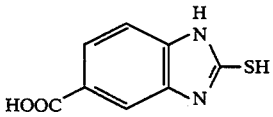

(1-2)

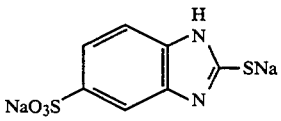

(1-3)

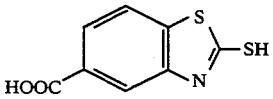

(1-4)

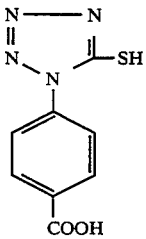

(1-5)

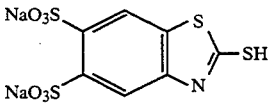

-continued (1-6)

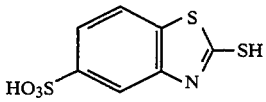

(1-7)

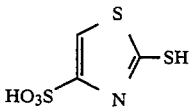

(1-8)

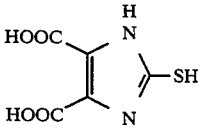

(1-9)

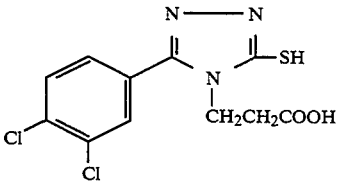

(1-10)

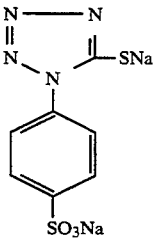

(1-11)

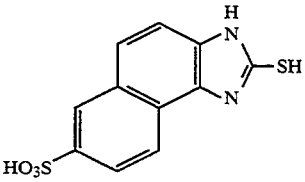

(1-12)

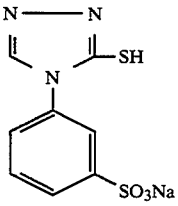

(1-13)

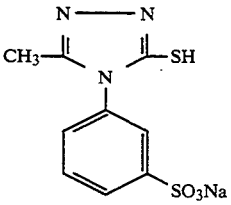

(1-14)

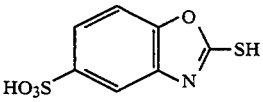

-continued (1-15)

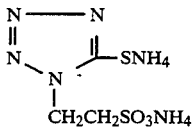

(1-16)

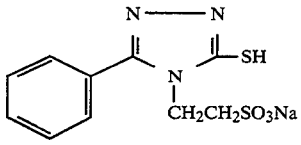

(1-17)

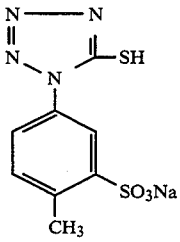

(1-18)

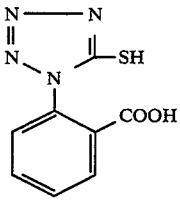

(1-19)

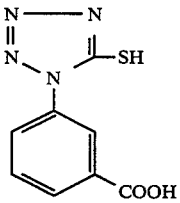

(1-20)

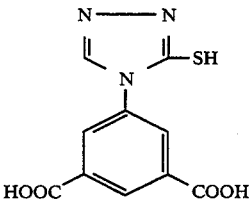

(1-21) $HS-CH_2-CH_2-COOH$ (1-22) $NaS-CH_2-CH_2-SO_3Na$ (1-23)

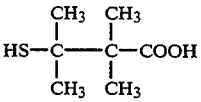

(1-24)

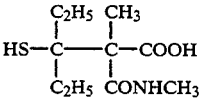

(1-25)

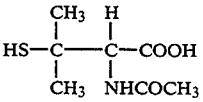

-continued (1-26)

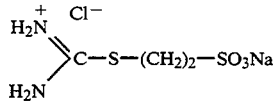

(1-27)

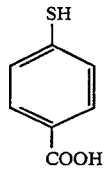

(1-28)

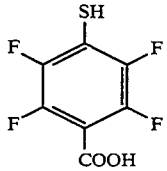

(1-29)

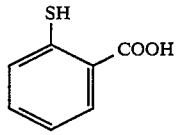

(1-30)

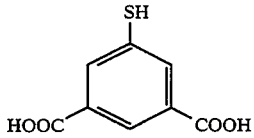

(1-31)

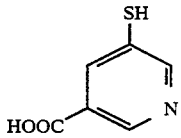

(1-32)

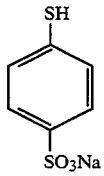

(1-33)

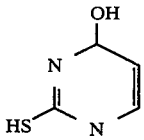

Next, Formula [2] will be explained.

In Formula [2] used in the present invention, $Z_{21}$ and $Y_{21}$ are rings respectively forming an unsaturated 5-membered or 6-membered ring (for example, a benzene ring, a pyrole ring, an imidazole ring, a pyrazole ring, a pyrimidine ring, a pyridamine ring); Z and Y contain together 3 or more nitrogen atoms in total and they have at least one mercapto group as a substituent. They may have a substituent other than a mercapto group. As aforesaid substituent, a halogen atom (for example, fluorine, chlorine and bromide), a lower alkyl group (including those having a substituent, and a methyl group and an ethyl group that have 5 or less carbon atoms are preferable), a lower alkoxy group (including those having a substituent, and a methoxy group, an ethoxy group and a buthoxy group that have 5 or less carbon atoms are preferable), a hydroxy group, a sulfo group, a lower aryl group (including those having a substituent, and those having 5 or less carbon atoms are preferable); an amino group, a COOH group, a carbamoyl group and a phenyl group are cited. It is especially preferable to have a water-solubilizing group such as a hydroxy group, a COOH group, an amino group and a sulfo group; and in Formula [2], compounds represented by the following Formulas [A] through [F] are especially preferable.

Formula [A]

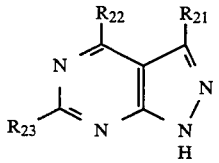

Formula [B]

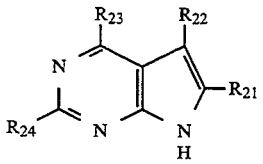

Formula [C]

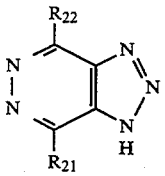

Formula [D]

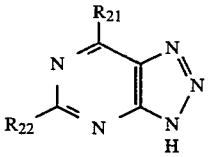

Formula [E]

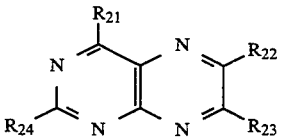

In Formulas $R_{21}$, $R_{22}$, $R_{23}$ and $R_{24}$ independently represent a hydrogen atom, a halogen atom, a lower alkyl group (including those having a substituent) having not more than 5 carbon atoms, such as a methyl group and an ethyl group, a lower alkoxy group (including those having a substituent, and those having 5 or less carbon atoms are preferable), a hydroxy group, a mercapto group, a sulfo group, a lower allyl group (including those having a substituent, and those having 5 or less carbon atoms are preferable), an amino group, a COOH group, a carbamoyl group and a phenyl group, provided that in Formulas [A], at least one of $R_{21}$ through $R_{23}$ is a mercapto group; in Formulas [B] and [E], at least one of $R_{21}$ through $R_{24}$ is a mercapto group; and in Formulas [C] and [D], at least one of $R_{21}$ and $R_{22}$ is a mercapto group. It is preferable that a substituent other than a mercapto group has a water-solubilizing group such as a hydroxy group, a COOH group, an amino group and a sulfo group.

Formula [F]

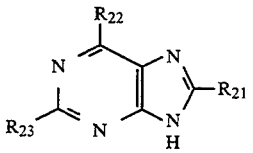

In Formula [F] , $R_{21}$, $R_{22}$ and $R_{23}$ independently represent a hydrogen atom, —$SM_{21}$ group, a hydroxy group, a lower alkoxy group, —$COOM_{22}$ group, an amino group, —$SO_3M_{23}$ or a lower alkyl group, provided that at least one of $R_{21}$, $R_{22}$ and $R_{23}$ represents —$SM_{21}$ group; $M_{21}$, $M_{22}$ and $M_{23}$, which may be the same or different, independently represent a hydrogen atom, an alkali metal atom or an ammonium group.

In the above-mentioned Formula [F], a lower alkyl group and a lower alkoxy group represented by $R_{21}$, $R_{22}$ and $R_{23}$ respectively have 1 to 5 carbon atoms, and they may have a substituent additionally. They are preferably a group having 1 to 3 carbon atoms. An amino group represented by $R_{21}$, $R_{22}$ and $R_{23}$ represents a substituted or unsubstituted amino group, and a preferable substituent is a lower alkyl group.

In the above-mentioned Formula [F], an ammonium group is a substituted or unsubstituted ammonium group, and the preferable is an unsubstituted ammonium group.

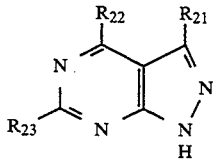

| | $R_{21}$ | $R_{22}$ | $R_{23}$ |
|---|---|---|---|
| 2-1 | H | H | SH |
| 2-2 | H | SH | H |
| 2-3 | $CH_3$ | H | SH |
| 2-4 | OH | H | SH |
| 2-5 | H | $NH_2$ | SH |
| 2-6 | Cl | SH | H |
| 2-7 | COOH | H | SH |

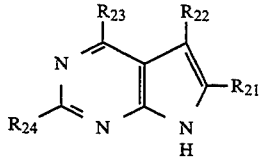

| | $R_{21}$ | $R_{22}$ | $R_{23}$ | $R_{24}$ |
|---|---|---|---|---|
| 2-8 | H | H | H | SH |
| 2-9 | Cl | H | H | SH |
| 2-10 | SH | H | H | H |
| 2-11 | $nC_5H_{11}$ | H | H | SH |
| 2-12 | OH | H | H | SH |
| 2-13 | H | H | OH | SH |
| 2-14 | SH | H | SH | H |

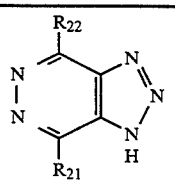

| | $R_{21}$ | $R_{22}$ |
|---|---|---|
| 2-15 | SH | H |
| 2-16 | SH | SH |

-continued

| | | |
|---|---|---|
| 2-17 | SH | COOH |
| 2-18 | SH | $SO_3H$ |
| 2-19 | SH | OH |

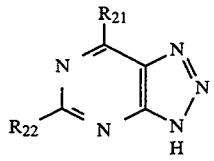

| | $R_{21}$ | $R_{22}$ |
|---|---|---|
| 2-20 | SH | H |
| 2-21 | SH | SH |
| 2-22 | SH | COOH |
| 2-23 | SH | $SO_3H$ |
| 2-24 | SH | OH |

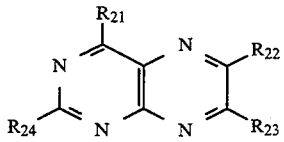

| | $R_{21}$ | $R_{22}$ | $R_{23}$ | $R_{24}$ |
|---|---|---|---|---|
| 2-25 | H | H | H | SH |
| 2-26 | H | H | SH | SH |
| 2-27 | OH | H | H | SH |
| 2-28 | H | $C_5H_{11}$ | H | SH |
| 2-29 | SH | COOH | H | H |
| 2-30 | H | H | $SO_3H$ | SH |

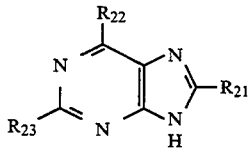

| | $R_{21}$ | $R_{22}$ | $R_{23}$ |
|---|---|---|---|
| 2-31 | H | H | SH |
| 2-32 | H | SH | OH |
| 2-33 | $CH_3$ | H | SH |
| 2-34 | OH | H | SH |
| 2-35 | H | OH | SH |
| 2-36 | Cl | SH | H |
| 2-37 | COOH | H | SH |
| 2-38 | H | $NH_2$ | SH |
| 2-39 | SH | OH | H |

In compounds represented by Formula [3], compounds selected from the following Formula [3-a] and Formula [3-b] are preferable.

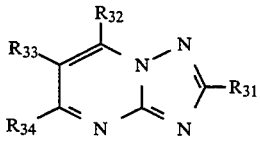

Formula [3-a]

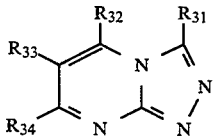

Formula [3-b]

In Formula [3-a] and Formula [3-b], $R_{31}$, $R_{32}$, $R_{33}$ and $R_{34}$ independently represent a hydrogen atom, $—SM_{31}$ group, a hydroxy group, a lower alkoxy group, $—COOM_{32}$ group, an amino group, $—SO_3M_{33}$ group or a lower alkyl group, provided that at least one of $R_{31}$, $R_{32}$, $R_{33}$ and $R_{34}$ represents $—SM_{31}$ group. $M_{31}$, $M_{32}$ and $M_{33}$, which may be the same or different, independently represent a hydrogen atom, an alkali metal atom or an ammonium group.

In above Formulas [3-a] and [3-b], a lower alkyl group and a lower alkoxy group represented by $R_{31}$, $R_{32}$, $R_{33}$ and $R_{34}$ are respectively those having 1 to 5 carbon atoms. They may have a substituent additionally. The preferable is a group having 1 to 3 carbon atoms. An amino group represented by $R_{31}$, $R_{32}$, $R_{33}$ and $R_{34}$ represents a substituted or unsubstituted amino group. The preferable substituent is a lower alkyl group.

In above Formula [3-a] and [3-b], an ammonium group is a substituted or unsubstituted one. The preferable is an unsubstituted ammonium group.

Hereunder, practical examples of the compounds represented by Formula [3-a] and [3-b] are shown. However, the present invention is not limited thereto.

Practical compounds represented by Formula [3-a] .

| | $R_{31}$ | $R_{32}$ | $R_{33}$ | $R_{34}$ |
|---|---|---|---|---|
| 3-a-1 | —SH | H | H | H |
| 3-a-2 | —SH | —OH | H | H |
| 3-a-3 | —SH | H | —OH | H |
| 3-a-4 | —SH | $—CH_3$ | —OH | H |
| 3-a-5 | —SH | $—NH_2$ | H | H |
| 3-a-6 | —SH | H | H | $—NH_2$ |
| 3-a-7 | —SH | H | $—CH_3$ | $—CH_3$ |
| 3-a-8 | —SH | H | H | —SH |
| 3-a-9 | —SH | —OH | H | —SH |
| 3-a-10 | —SH | H | H | —COOH |
| 3-a-11 | H | —SH | H | H |
| 3-a-12 | —SH | —SH | H | H |
| 3-a-13 | H | —SH | —OH | H |
| 3-a-14 | H | —SH | $—NH_2$ | H |
| 3-a-15 | H | —SH | —OH | $—CH_3$ |
| 3-a-16 | H | —SH | $—NH_2$ | $—C_2H_5$ |
| 3-a-17 | H | —SH | H | $—CH_3$ |
| 3-a-18 | H | —SH | H | —OH |
| 3-a-19 | H | —SH | H | —COOH |
| 3-a-20 | H | —SH | H | $—SO_3H$ |
| 3-a-21 | H | H | —SH | H |
| 3-a-22 | —OH | H | —SH | H |
| 3-a-23 | —OH | $—CH_3$ | —SH | H |
| 3-a-24 | $—NH_2$ | H | —SH | H |
| 3-a-25 | —SH | H | —SH | H |
| 3-a-26 | H | H | H | —SH |
| 3-a-27 | H | —OH | H | —SH |
| 3-a-28 | —OH | H | H | —SH |
| 3-a-29 | $—NH_2$ | H | H | —SH |
| 3-a-30 | H | $—NH_2$ | H | —SH |
| 3-a-31 | H | $—NH_2$ | $—CH_3$ | —SH |
| 3-a-32 | —SH | H | H | —SH |
| 3-a-33 | —SH | $—CH_3$ | H | —SH |
| 3-a-34 | H | $—OCH_3$ | H | —SH |
| 3-a-35 | —SH | —SH | H | —SH |
| 3-a-36 | H | $—CH_3$ | $—CH_3$ | —SH |

Practical compounds represented by Formula [3-b].

| | $R_{31}$ | $R_{32}$ | $R_{33}$ | $R_{34}$ |
|---|---|---|---|---|
| 3-b-1 | H | H | $—NH_2$ | —SH |
| 3-b-2 | H | $—CH_3$ | $—NH_2$ | —SH |
| 3-b-3 | H | H | —SH | —SH |
| 3-b-4 | —OH | H | —SH | —SH |
| 3-b-5 | H | H | —COOH | —SH |
| 3-b-6 | H | H | H | —SH |
| 3-b-7 | —OH | H | H | —SH |
| 3-b-8 | H | —OH | H | —SH |
| 3-b-9 | $—CH_3$ | —OH | H | —SH |
| 3-b-10 | $—NH_2$ | H | H | —SH |
| 3-b-11 | —OH | H | —SH | H |
| 3-b-12 | $—NH_2$ | H | —SH | H |
| 3-b-13 | —OH | $—CH_3$ | —SH | H |
| 3-b-14 | $—NH_2$ | $—C_2H_5$ | —SH | H |

-continued

| | $R_{31}$ | $R_{32}$ | $R_{33}$ | $R_{34}$ |
|---|---|---|---|---|
| 3-b-15 | H | $-CH_3$ | —SH | H |
| 3-b-16 | H | —OH | —SH | H |
| 3-b-17 | H | H | —SH | H |
| 3-b-18 | —OH | H | —SH | $-CH_3$ |
| 3-b-19 | —OH | $-CH_3$ | —SH | H |
| 3-b-20 | $-NH_2$ | H | —SH | H |
| 3-b-21 | —SH | H | —SH | H |
| 3-b-22 | H | —SH | H | —OH |
| 3-b-23 | H | —SH | —OH | $-NH_2$ |
| 3-b-24 | H | —SH | $-NH_2$ | H |
| 3-b-25 | H | —SH | —COOH | H |
| 3-b-26 | H | —SH | H | H |
| 3-b-27 | $-OCH_3$ | —SH | H | H |
| 3-b-28 | H | —SH | H | $-SO_3H$ |
| 3-b-29 | —SH | H | H | H |
| 3-b-30 | —SH | —OH | H | H |
| 3-b-31 | —SH | H | H | $-NH_2$ |
| 3-b-32 | —SH | $-CH_3$ | H | H |

The amount of any compound represented by Formuls [1] through [3] of the present invention is preferably $10^{-5}$ mol to $10^{-1}$ mol per 1 l of developing solution. It is especially preferable to be $10^{-4}$ to $10^{-2}$ mol.

The compounds of the present invention are well-known and easily available.

The compounds of the present invention have a function to prevent silver sludge by trapping silver dissolved. In addition, they can keep the effect of the developing solution to prevent silver sludge, showing excellent effect during a period of long term storage. Accordingly, they make the rapid photographic processing possible and present a fall of fixing speed.

As a hydrazine derivative used in the present invention, compounds represented by the following Formula [H] are preferable.

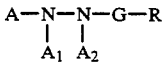

Formula [H]

wherein A represents an aryl group or a heterocycle containing at least one of an sulfur atom or an oxygen atom; G represents a $-\overset{O}{\overset{\|}{C}}-_n$ group, a sulfonyl group, a sulfoxy group, a $-\overset{O}{\overset{\|}{P}}-$ (R) group, or an iminomethylene group; n represents an integer of 1 or 2; both of $A_1$ and $A_2$ represent a hydrogen atom, or one of them is a hydrogen atom and the other is a substituted or unsubstituted alkylsulfonyl group or a substituted or unsubstituted acyl group; R represents a hydrogen atom, an alkyl group, an aryl group, an alkoxy group, an aryloxy group, an amino group, a carbamoyl group, an oxycarbonyl group or $-O-R_2$ group; and $R_2$ represents an alkyl group or a saturated heterocycle.

In the present invention, of the above-mentioned compounds, compounds represented by the following Formula [H-a] or [H-b] are especially preferable.

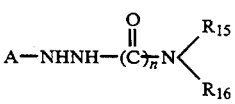

Formula [H-a]

-continued

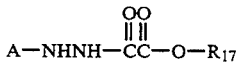

Formula [H-b]

In Formula, A represents an aryl group or a heterocycle containing at least one sulfur atom or an oxygen atom; n represents an integer of 1 or 2. When n=1, $R_{15}$ and $R_{16}$ independently represent a hydrogen atom, an alkyl group, an alkenyl group, an alkinyl group, an aryl group, a heterocycle, a hydroxy group, an alkoxy group, an alkenyloxy group, an alkinyloxy group, an aryloxy group or a heterocyclic oxy group. $R_{15}$ and $R_{16}$may form a ring with a nitrogen aton. When n=2, $R_{15}$ and $R_{16}$ independently represent a hydrogen atom, an alkyl group, an alkenyl group, an alkinyl group, an aryl group, a saturated or unsaturated heterocycle, a hydroxy group, an alkoxy group, an alkenyloxy group, an alkinyloxy group, an aryloxy group or a heterocyclic oxy group, provided that at least one of $R_{15}$ and $R_{16}$ represents an alkenyl group, an alkinyl group, a saturated heterocycle, a hydroxy group, an alkoxy group, an alkenyloxy group, an alkinyloxy group, an aryloxy group or a heterocyclic oxy group; and $R_{17}$ represents an alkinyl group or a saturated heterocycle.

Compounds represented by Formula [H-a] or [H-b] include those wherein at least either H of —NHNH— in the Formula is substituted with a substituent.

More particularly, A represents an aryl group (for example, a phenyl group and a naphthyl group) or a heterocycle containing at least one sulfur atom or oxygen atom (for example, a thiophene group, a furan group, a benzothiophene group and a pyran group).

$R_{15}$ and $R_{16}$ independently represent a hydrogen atom, an alkyl group (for example, a methyl group, an ethyl group, a methoxyethyl group, a cyanoethyl group, a hydroxyethyl group, a benzyl group and a trifluoroethyl group), an alkenyl group (for example, an allyl group, a buthenyl group, a pentenyl group and a pentadienyl group), an alkinyl group (for example, a propargyl group, a butinyl group and a pentynyl group), an aryl group (for example, a phenyl group, a naphtyl group, a cyanophenyl group and a methoxyphenyl group), a heterocycle (for example, an unsaturated heterocycle such as a pyridine group, a thiophene group and a furan group and a saturated heterocycle such as a tetrahydrofuran group and a sulforane group), a hydroxy group, an alkoxy group (for example, a methoxy group, an ethoxy group, a benzyloxy group and a cyanomethoxy group), an alkenyloxy group (for example, an allyloxy group and a butenyloxy group), an alkinyloxy group (for example, a propargyloxy group and a butynyloxy group), an aryloxy group (for example, a phenoxy group and a naphtyloxy group) or a heterocyclic oxy group (for example, a pyridyloxy group and a pyridymyloxy group). When n=1, $R_{15}$ and $R_{16}$ may form a ring (for example, a pyperidine group, a pyperadine group and a morphorine group) in combination with a nitrogen atom.

However, when n is 2, at least one of $R_{15}$ and $R_{16}$ represents an alkenyl group, an alkinyl group, a saturated heterocycle, a hydroxy group, an alkoxy group, an alkenyloxy group, an alkinyloxy group, an aryloxy group or a heterocyclic oxy group. As examples of alkinyl group and a saturated heterocycle represented by $R_{17}$, the above-mentioned groups are cited.

To an aryl group represented by A or a heterocycle having at least one of a sulfur atom or a oxygen atom, various substituents can be introduced. As a substituent capable of being introduced thereto, a halogen atom, an alkyl group, an aryl group, an alkoxy group, an aryloxy group, an acyloxy group, an alkylthio group, an arylthio group, a sulfonyl group, an alkoxycarbonyl group, an aryloxycarbonyl group, a carbamoyl group, a sulfamoyl group, an acyl group, an amino group, an alkylamino group, an arylamino group, an acylamino group, a sulfonamide group, an arylaminothiocarbonylamino group, a hydroxy group, a carboxy group, a sulfo group, a nitro group and a cyano group are cited. Of these substituents, the sulfonamide group is preferable.

In each Formula, it is preferable that A contains at least one anti-diffusion group or a silver halide absorption accelerating group. An an anti-diffusion group, a ballast group ordinarily used in a immobile photographic additive such as a coupler is preferable. The ballast group having 8 or more carbon atoms, is relatively inert photographically, having 8 or more carbon atoms, and can be selected from an alkyl group, an alkoxy group, a phenyl group, an alkylphenyl group, a phenoxy group and an alkylphenoxy group.

As a silver halide absorption accelerating group, a thiourea group, a thiourethane group, a heterocyclic thio amide group, a mercapto heterocycle and a triazole group that are described in U.S. Pat. No. 4,385,108 are cited.

H of —NHNH— in Formula [H-c] and [H-d], namely a hydrogen atom of hydrazine may be substituted with a substituent such as a sulfonyl group (for example, a methansulfonyl group and a toluenesulfonyl group), an acyl group (for example, an acetyl group, a trifluoroacetyl group and an ethoxycarbonyl group) and an oxalyl group (for example, an ethoxalyl group and a pyruvoyl group). These are also included in compounds represented by Formulas [H-a] and [H-b].

In the present invention, the preferable are ones represented by Formula [H-a] when n is 2 and ones represented by Formula [H-b].

In the compounds of Formula [H-a] when n=2, it is preferable that $R_{15}$ and $R_{16}$ independently represent a hydrogen atom, an alkyl group, an alkenyl group, an alkinyl group, an aryl group, a saturated or unsaturated heterocycle, a hydroxy group or an alkoxy group and, concurrently, at least one of $R_{31}$ and $R_{32}$ represents an alkenyl group, an alkinyl group, a saturated heterocycle, a hydroxy group or an alkoxy group.

Typical compounds represented by the above-mentioned Formulas [H-a] and [H-b] are shown below. However, practical compounds which are represented by Formulas [H-a] and [H-b] and can be used in the present invention are not limited to the undermentioned compounds.

EXAMPLES OF PRACTICAL COMPOUNDS c-1

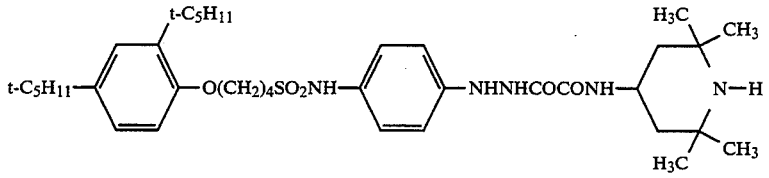

c-2

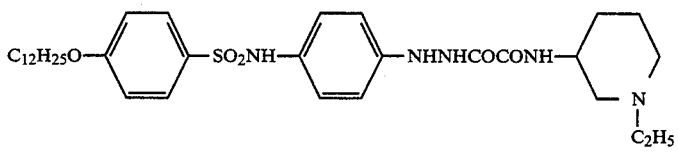

c-3

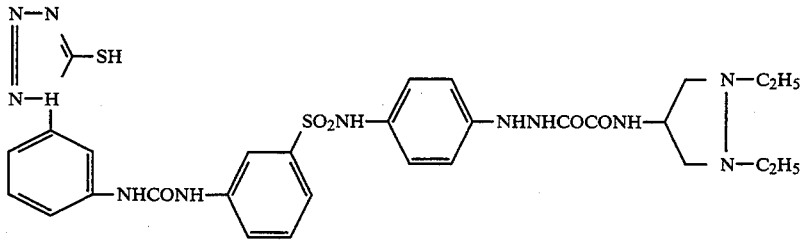

d-1

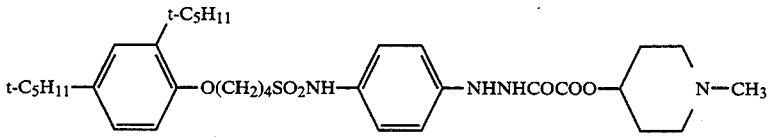

c-4

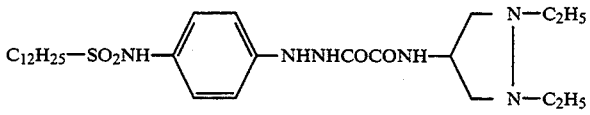

-continued c-5

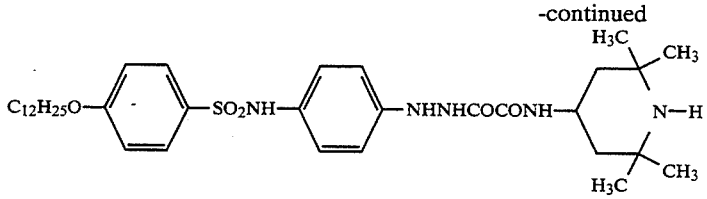

d-2

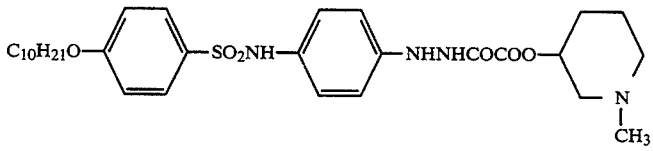

c-6

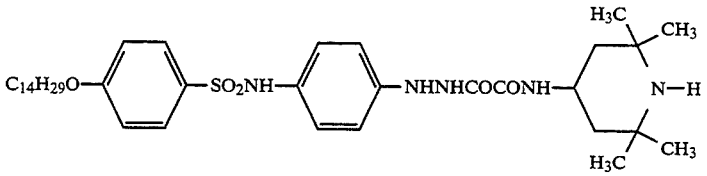

d-3

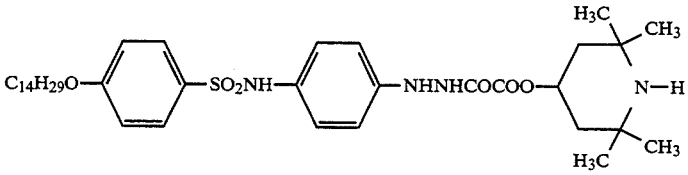

c-7

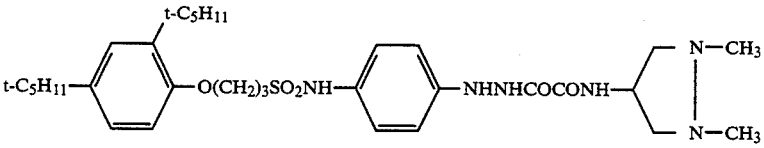

d-4

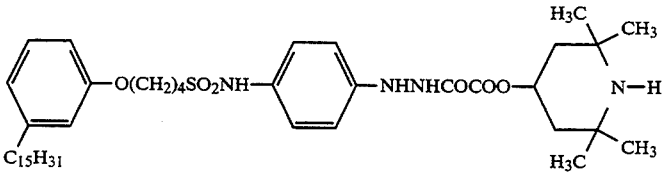

c-8

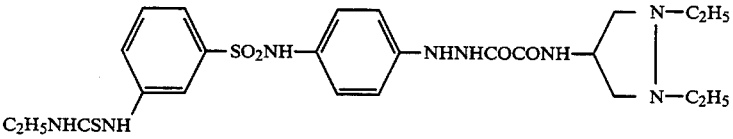

d-5

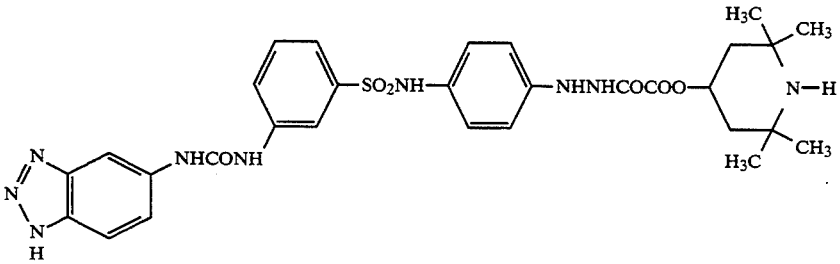

As practical compounds other than the above-mentioned compounds, examples of compounds Nos. (1) through (61) and (65) through (75) described on pp. 542(4) through 546(8) in Japanese Patent O.P.I. Publication No. 841/1990 are cited.

The hydrazine derivatives of the present invention can be synthesized by a method described in Japanese Patent O.P.I. Publication No. 841/1990, pp. 546(8) through 550(12).

The hydrazine derivative of the present invention is to be added to a silver halide emulsion layer and/or a layer adjacent thereto. The amount to be added is preferably $1\times10^{-6}$ to $1\times10^{-1}$ mol per mol of silver and more preferably $1\times10^{-5}$ to $1\times10^{-2}$ mol per mol of silver.

When [H-a] or [H-b] is contained as a hydrazine derivative, it is preferable that at least one kind of nucleation-accelerating compound out of those described on the 1st line of the lower left column on page 7 up to 11th line on the lower left column on page 11 of Japanese Patent O.P.I. Publication No. 98239/1992 is contained in a silver halide emulsion layer and/or in a non-sensitive layer located on the side having thereon the silver halide emulsion layer on the support.

As typical practical examples of the nucleation-accelerating agents, the following can be cited.

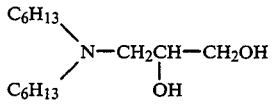
N-1

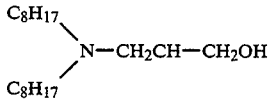
N-2

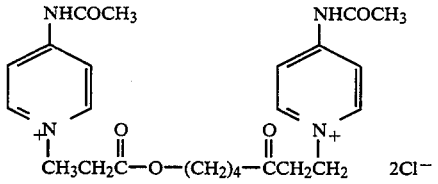
N-3

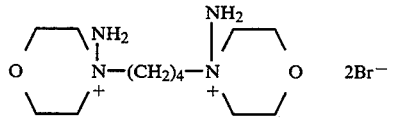
N-4

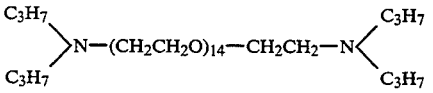
N-5

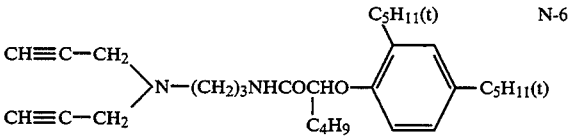
N-6

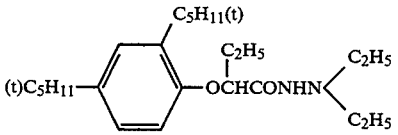
N-7

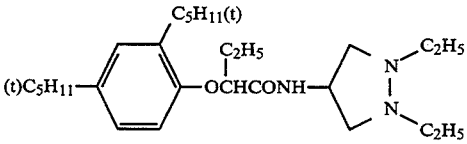
N-8

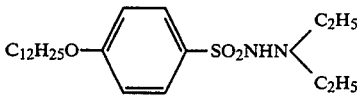
N-9

-continued

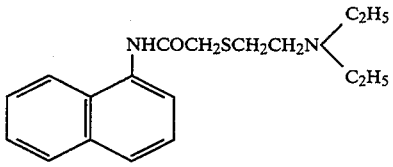
N-10

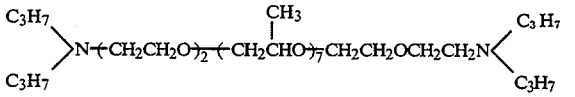
N-11

As further practical examples other than the aforementioned typical and practical examples, there are given the compounds which do not belong to the aforementioned typical and practical examples and are included in compounds I-1 through 1-26 on page 8, compounds II-1 through II-29 on pages 9 and 10, compounds III-1 through III-25 described in pp. 10 to 11, compounds IV-1 through IV-41 on page 84 through 90, compound V-I-1 through V-I-27 on pages 11 through 13, compounds V-II-1 through V-II-30 on pages 13 and 14, compound V-III-35 described on page 16, compounds VI-I-1 through VI-I-44 on pages 18 through 20, compounds VI-II-1 through VI-II-68 described on pp. 21 through 24 and compounds VI-III-1 through VI-III-35 described on pp. 24 though 26 all in Japanese Patent O.P.I. Publication No. 98239/1992.

As examples of a redox group of a redox compound capable of releasing a development inhibitor by being oxidized, hydroquinones, cathecols, naphthohydroquinones, aminophenols, pyrazolidones, hydrazines, hydroxylamines and reductones are cited. As a redox group, hydrazines are preferable. As a redox compound, compounds represented by the following Formula [R] are especially preferable.

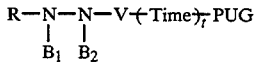
Formula [R]

In Formula [R], both of $B_1$ and $B_2$ represent a hydrogen atom or a sulfonic acid radical substituent, or either of them is a hydrogen atom and the other is a sulfinic acid radical substituent, for example an alkylsulfonyl group and an aryl sulfonyl group each having 20 or less carbon atoms (preferably a phenylsulfonyl group or a substituted phenylsulfonyl group wherein the sum of substituent constant of Hamett is −0.5 or more) or —C(O)—$R_0$ [wherein $R_0$ preferably represents a straight-chained, branched-chained or cyclic alkyl group having 30 or less carbon atoms, an alkenyl group, an aryl group (preferably a phenyl group or a substituted phenyl group wherein the sum of substituent constant of Hamett is −0.5 or more), an alkoxy group (for example, an ethoxy group), an aryloxy group (preferably a mono-ring)]. These groups may have a substituent. As a substituent, for example, the following groups are cited. These groups may be substituted additionally. For example, there are given an alkyl group, an aralkyl group, an alkenyl group, an alkinyl group, an alkoxy group, an aryl group, a substituted amino group, an acylamino group, a sulfonylamino group, an ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an aryloxy carbonyl group, an acyl group, an alkoxycarbonyl group, an acyloxy group, a carbonamide group, a sulfonamide group, a nitro group, an alkylthio group and an arylthio group. A sulfinic acid radical substituent represented by $B_1$ and $B_2$ represent those described in U.S. Pat. No. 4,478,928.

In addition, $B_1$ may form a ring through combination with —(Time)$_t$— described later.

As $B_1$ and $B_2$, hydrogen atoms are the most preferable.

Time represents a divalent linking group. It may have a timing-adjusting function. t represents 0 or 1. When t is 0, this means that PUG is bonded directly to V.

The divalent linking group represented by Time represents a group which may release PUG after one or more step of reaction from Time-PUG released from the oxidized product of an acidizing-reduction mother nucleus.

As a divalent linking group represented by Time, for example, there are given those releasing a photographically useful group (PUG) through an intramolecular ring-closure reaction of p-nitrophenoxy derivative described in U.S. Pat. No. 2,248,962 (Japanese Patent O.P.I. Publication No. 145135/1979); those releasing PUG through intramolecular ring-closure reaction after ring cleavage described in U.S. Pat. No. 4,310,612 (Japanese Patent O.P.I. Publication No. 53330/1980) and U.S. Pat. No. 4,358,252; those releasing PUG accompanied by the production of acid anhydrade due to intramolecular ring-closure reaction of succinic acid monoester or the carboxyl group of its relative described in U.S. Pat. Nos. 4,330,617, 4,446,216 and 4,483,919 and Japanese Patent O.P.I. Publication No. 121328/1984; those releasing PUG through the production of quinomonomethane or its relative due to the movement of electrone through double binding wherein an aryloxy group or a heterocyclic oxy group is conjugated described in U.S. Pat. Nos. 4,409,323, 4,421,845, Research Disclosure No. 21,228 (December of 1981), U.S. Pat. No. 4,416,977 (Japanese Patent O.P.I. Publication No. 135944/1982) and Japanese Patent O.P.I. Publication Nos. 209736/1983 and 209738/1983; those releasing PUG from $\gamma$ position of enamine due to electrone movement of a portion having an anamine structure of a nitrogen-containing heterocycle described in U.S. Pat. No. 4,420,554 (Japanese Patent O.P.I. Publication No. 136640/1982) and Japanese Patent O.P.I. Publication Nos. 135945/1982, 188035/1982, 98728/1983 and 209737/1983; those releasing PUG through intramolecular ring-closure reaction of an oxy group produced due to electrone movement to a carbonyl group conjugating with a nitrogen atom in a nitrogen-containing heterocycle described in Japanese Patent O.P.I. Publication No. 56837/1982; those releasing PUG accompanied by the production of an aldehyde described in U.S. Pat. No. 4,146,396 (Japanese Patent O.P.I. Publication No. 90932/1977), Japanese Patent O.P.I. Publication Nos. 93442/1984 and 75475/1984; those releasing PUG accompanied by the removal of carbonic acid of a carboxyl group described in Japanese Patent O.P.I. Publication Nos. 146828/1976, 179842/1982 and 104641/1984; those having the structure of —O—COOCR$_2$R$_6$—PUG and releasing PUG accompanied by the removal of carbonic acid the succeeding production of aldehyde; those releasing PUG accompanied by the production of isocyanate described in Japanese Patent O.P.I. Publication No. 7429/1985; and those releasing PUG through coupling reaction with an oxidized product of a color developing agent described in U.S. Pat. No. 4,438,193.

Practical examples of divalent linking group represented by Time are also described in detail in Japanese Patent O.P.I. Publication No. 236549/1986 and Japanese Patent Application No. 98803/1988.

PUG represents a photographically useful group, which is preferably a development inhibitor or a development accelerator.

As a development inhibitor, a mercapto tetrazole derivative, a mercaptotriazole derivative, a mercapto imidazole derivative, a mercapto pyrimydine derivative, a mercapto benzimidazole derivative, a mercapto thiadiazole derivative, a mercapto benzthiazole derivative, a mercapto benzoxazole derivative, a benztriazole derivative, a benzimidazole derivative, an indazole derivative, a tetrazole derivative, a tetrazaindene derivative and a mercaptotriazole derivative are cited.

V represents a carbonyl group, —C(O)C(O)—, a sulfonyl group, a sulfoxy group, —P(O)(R$_{14}$)—R$_1$ (wherein R$_1$ represents an alkoxy group or an aryloxy group), an iminomethylene group and a thiocarbonyl group. Of these, the carbonyl group is preferable. An aliphatic acid group represented by R includes a straight-chained, branched-chained or cyclic alkyl group, an alkenyl group or an alkynyl group. The preferable carbon number therein is 1 to 30, and the especially preferable is 1 to 20. Here, a branched alkyl group may be cycled so that a saturated heterocycle containing one or more hetero atom is formed therein.

For example, a methyl group, a t-butyl group, an n-octyl group, a t-octyl group, a cyclohexyl group, a hexenyl group, a pyrolidyl group, a tetrahydrofuryl group and an n-dodecyl group are cited.

An aromatic group is a monocyclic or bicyclic aryl group, including a phenyl group and a naphthyl group.

A heterocycle is a 3 to 10-membered saturated or unsaturated heterocycle containing at least one of N, O or S atom. It may be a monocycle or may form a condensed ring with other aromatic ring or a heterocycle. As a heterocycle, the preferable is a 5-membered or 6-membered aromatic heterocycle including a pyridine ring, an imidazolyl group, a quinolynyl group, a benzimidazole group, a pyrimidinyl group, a pyrazolyl group, an isoquinolynyl group and a benzthiazolyl group and a thiazolyl group.

R may be substituted with a substituent. As a substituent, the following ones are cited. These groups may be substituted additionally.

The substituents include an alkyl group, an aralkyl group, an alkenyl group, an alkinyl group, an alkoxy group, an aryl group, a substituted amino group, an acylamino group, a sulfonylamino group, an ureido group, an urethane group, an aryloxy group, a sulfomoyl group, a carbamoyl group, an alkylthio group, an arylthio group, a sulfothio group, a sulfinyl group, a hydroxy group, a halogen atom, a cyano group, a sulfo group, an alkyloxy carbonyl group, an aryloxycarbonyl group, an acyl group, an alkoxycarbonyl group, an acyloxy group, a carbonamide group, a sulfonamide group, a carboxy group and a phosphoric acid amide group.

In R or —(Time)$_t$—PUG of Formula [R], a group which is a ballast group conventionally used in an additive for immobile photography use such as a coupler therein and a compound represented Formula [R} may be incorporated.

A ballast group is an organic group providing a molecular weight enough for preventing a compound represented by Formula [R] from diffusing substantially to other layers or processing solutions, including the following group or a combination thereof; an alkyl group, an aryl group, a heterocycle, an ether group, a thioether group, an amide group, an ureido group, an urethane group and a sulfonamide group. A ballast group is preferably one having a substituted benzene ring, and especially preferably a ballast group having a benzene group substituted with a branched alkyl group.

As an adsorption accelerating group to silver halide, a cyclic thioamide group such as a 4-thiazoline-2-thion group, a 4-imidazoline-2-thione group, a 2-thiohydantoine group, a rhodanine group, a thiobarbitaric acid group, a tetrazoline-5-thione group, a 1,2,4-triazoline-3-thione group, 1,3,4-oxAzoline-2-thion, benzimidazoline-2-thion, a benzoxazoline-2-thione group, a benzothiazoline-2-thione group, a thiotriazine group and a 1,3-imidazoline-2-thione, a chain type thioamide group, an aliphalic mercapto group, an aromatic mercapto group, a heterocyclic mercapto group (when a nitrogen atom is located in adjacent to a carbon atom wherein a —SH group is linked, it is the same as a cyclic thioamide group which is a tautomer of it, and practical examples thereof are the same as those described as above), a group having a disulfide binding, a 5-membered or 6-membered nitrogen-containing heterocycle composed of nitrogen, oxygen, sulfur and carbon such as a benzotriazole group, a triazole group, a tetrazole group, an indazole group, a benzimidazole group, an imidazole group, a benzothiazole group, an oxazole group, a thiozole group, a thiazoline group, a benzoxazole group, an oxazole group, an oxazoline group, a thiadiazole group, an oxazoline group, a thiadiazole group, an oxathiazole group, a triazine group and a azaindene group and a heterocyclic quarternary salt and heterocyclic quarternary salts such as benzimidazolinium are cited.

These may be substituted with a suitable substituent. As a substituent, those described as a substituent of R are cited.

Hereunder, practical examples of compounds used in the present invention are illustrated. However, the present invention is not limited thereto.

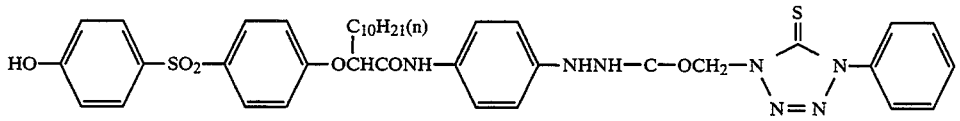

R-1

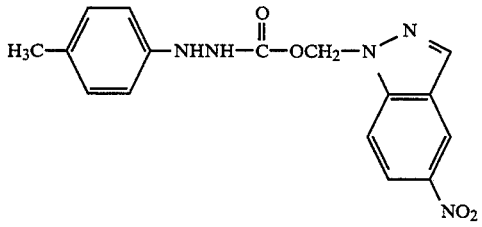

R-2

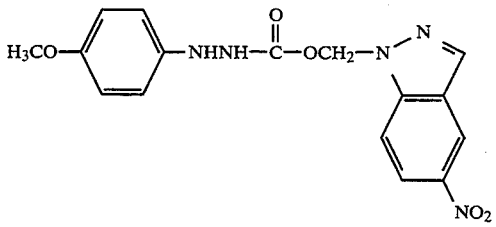

R-3

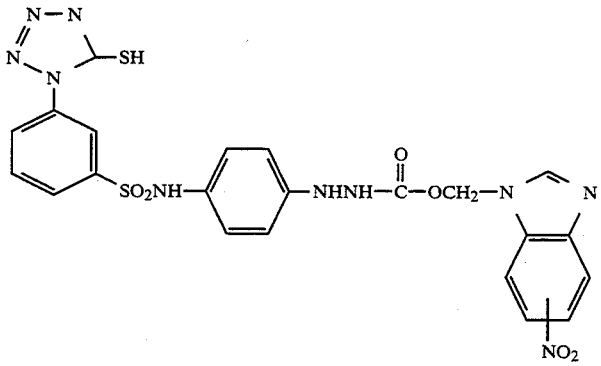

R-4

-continued
R-5
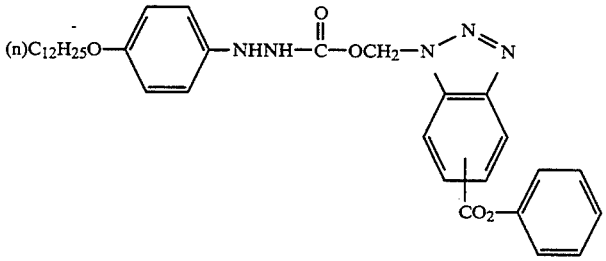
R-6
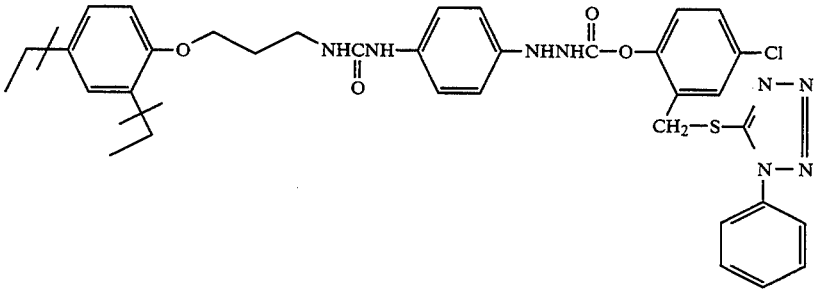
R-7
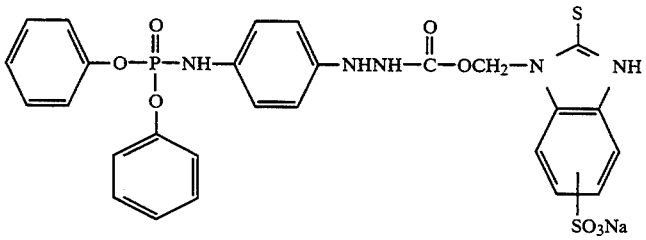
R-8
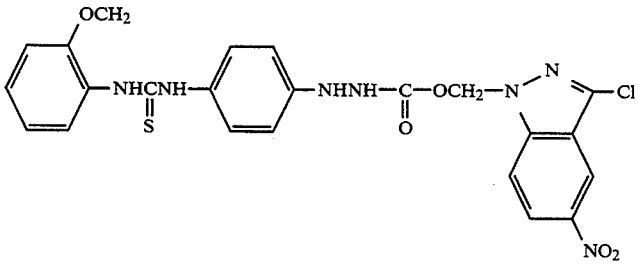
R-9
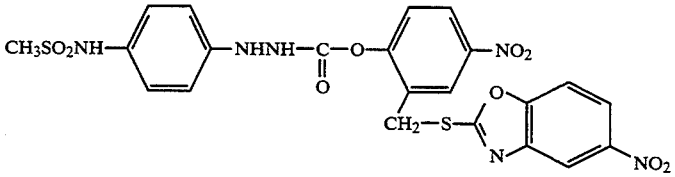
R-10
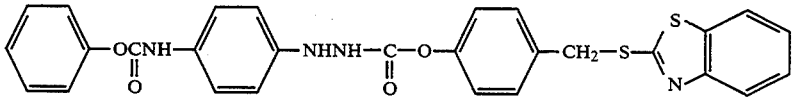

-continued
R-11
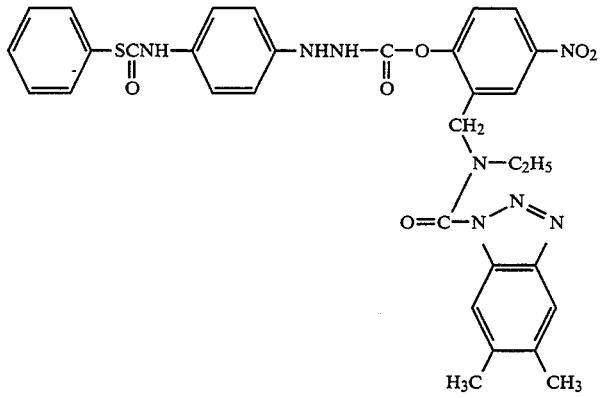
R-12
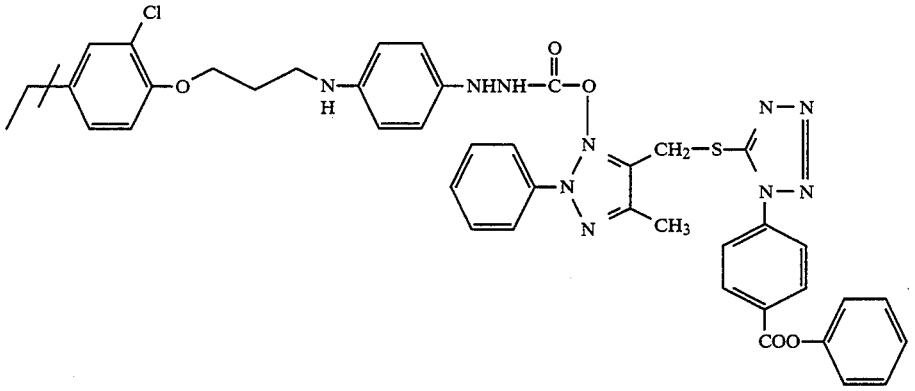
R-13
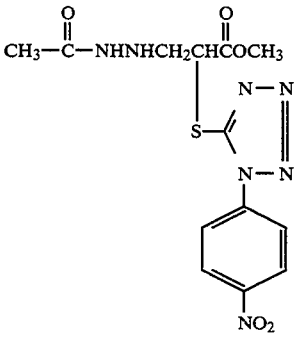
R-14
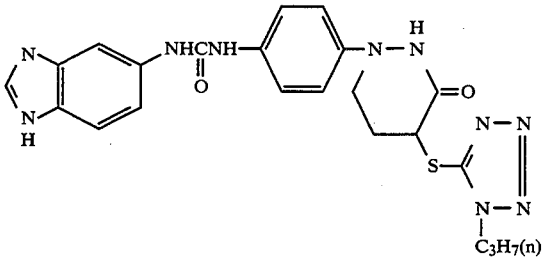
R-15
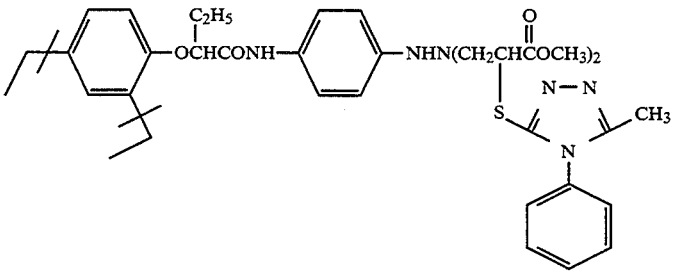

-continued
R-16
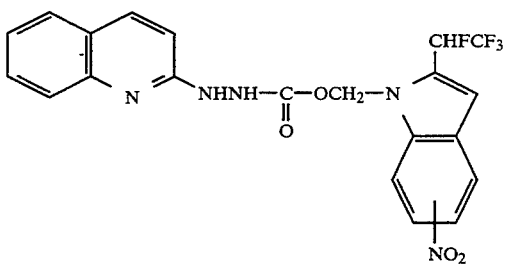
R-17
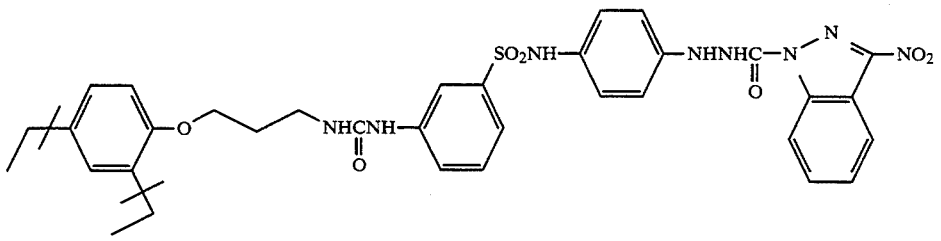
R-18
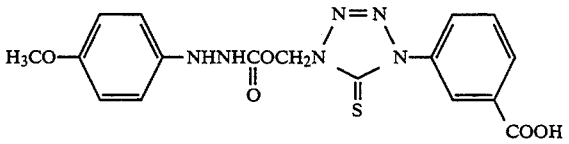
R-19
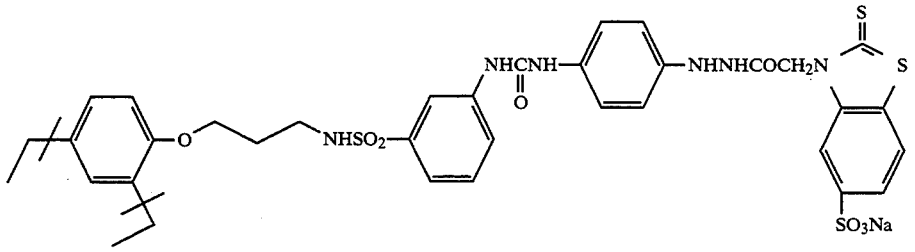
R-20
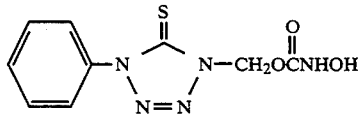
R-21
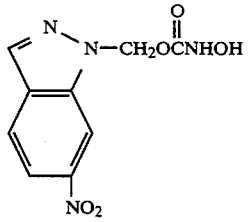
R-22
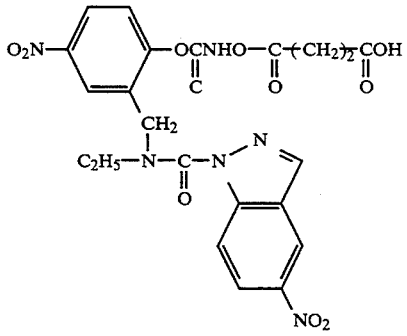

-continued
R-23
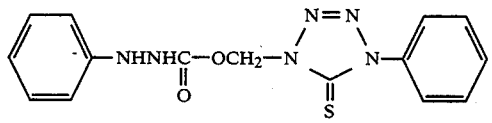
R-24
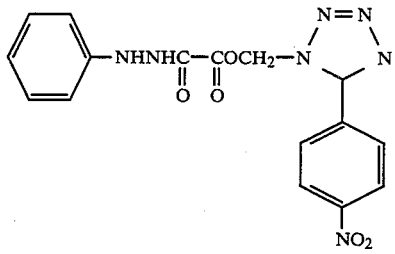
R-25
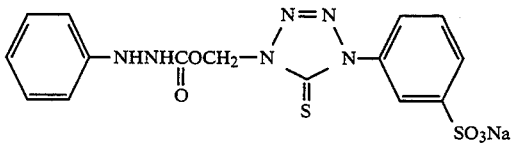
R-26
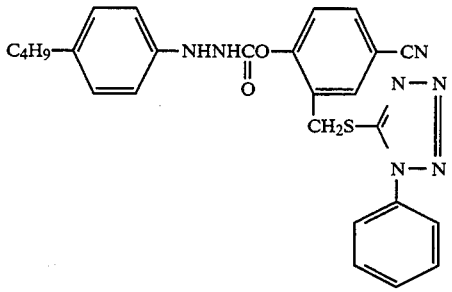
R-27
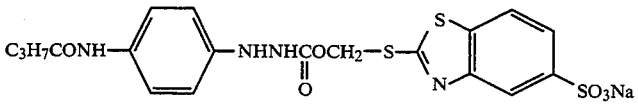
R-28
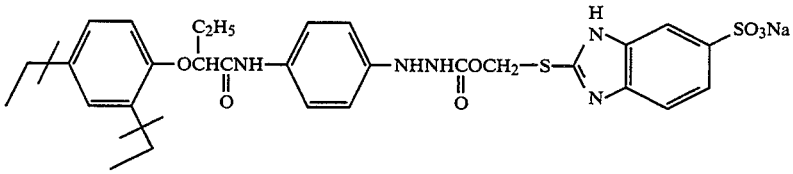
R-29
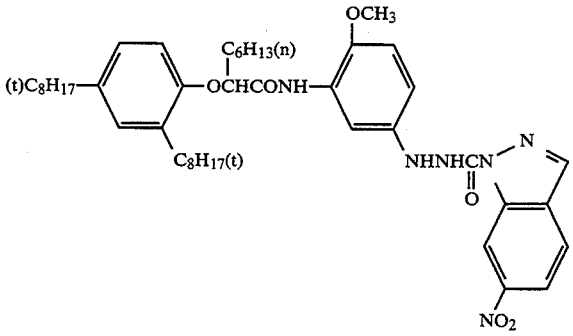

-continued
R-30
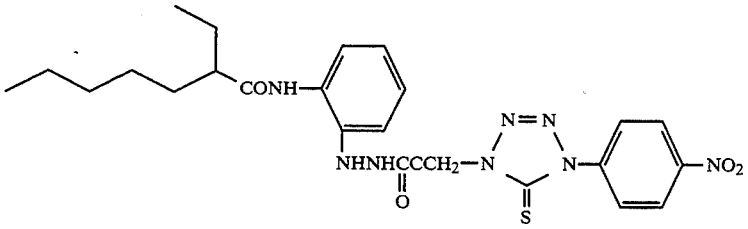
R-31
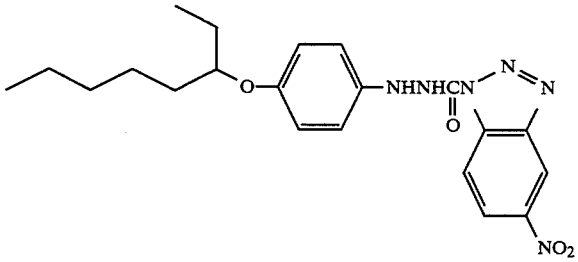
R-32
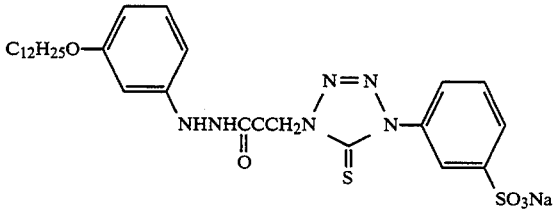
R-33
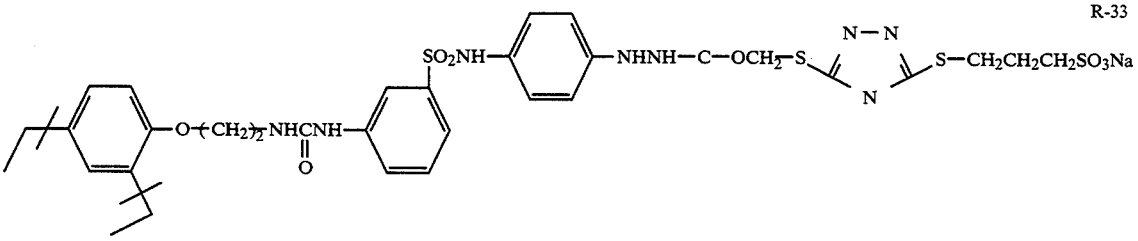
R-34
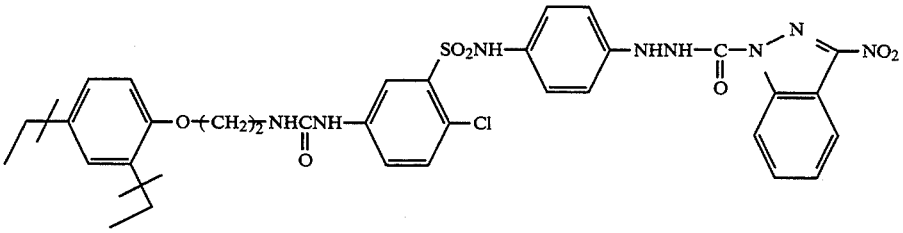
R-35
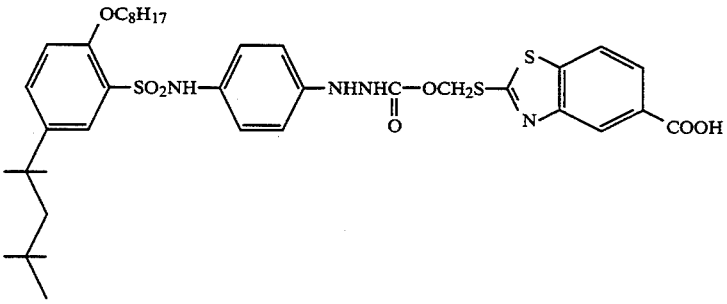

-continued
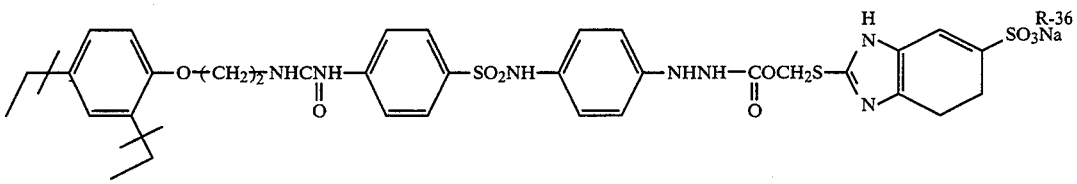
R-36
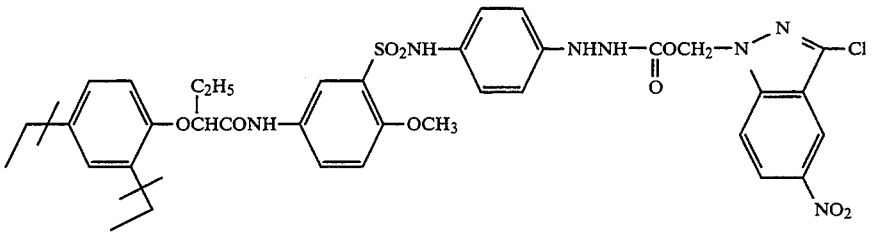
R-37
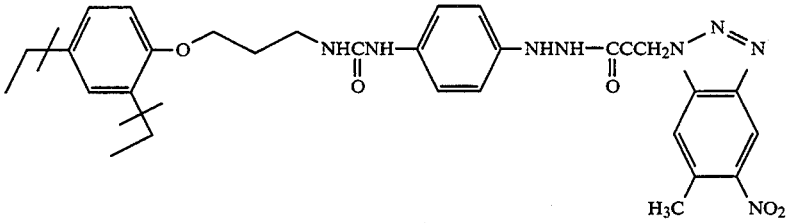
R-38
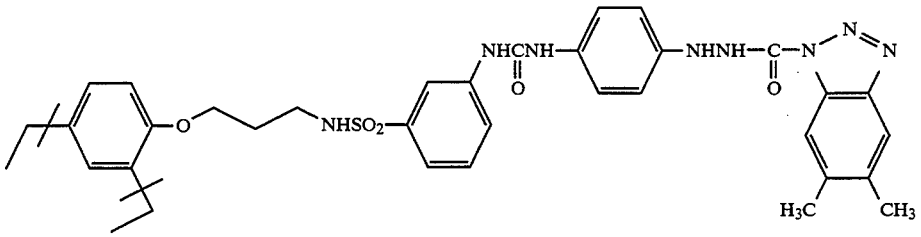
R-39
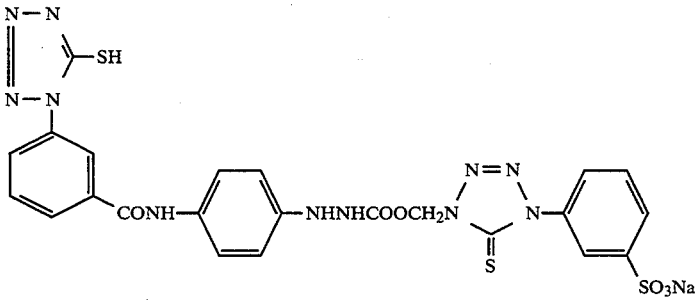
R-40
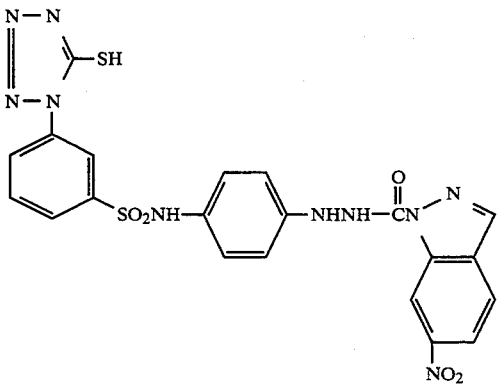
R-41

-continued
R-42
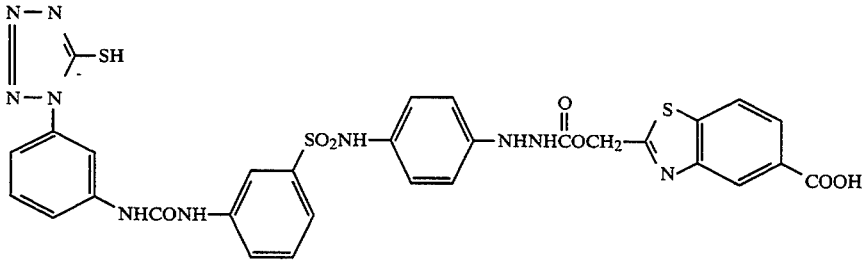
R-43
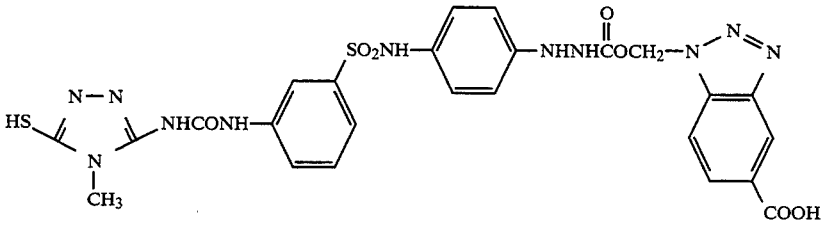
R-44
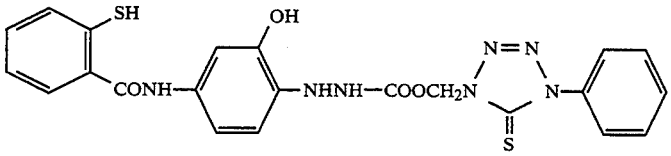
R-45
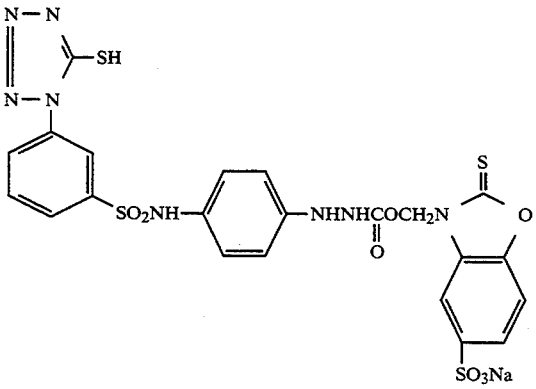
R-46
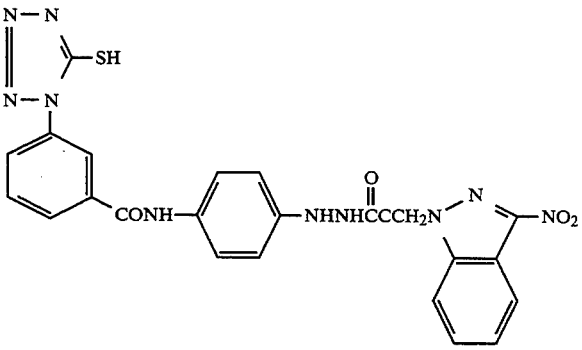
R-47
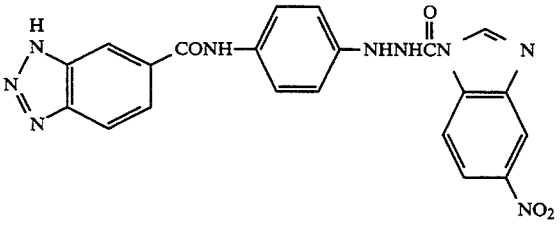

-continued
R-48
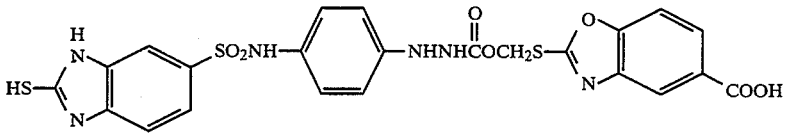
R-49
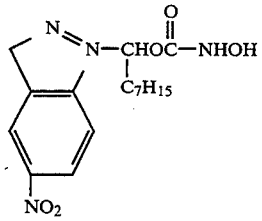
R-50
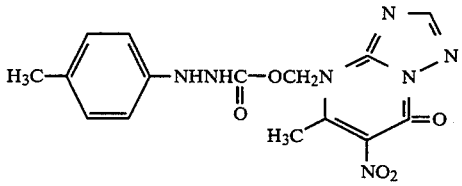
R-51
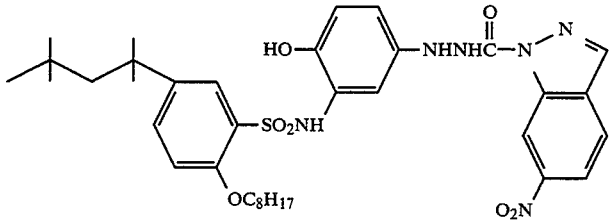
R-52
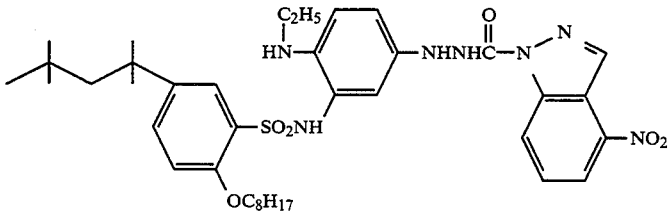
R-53
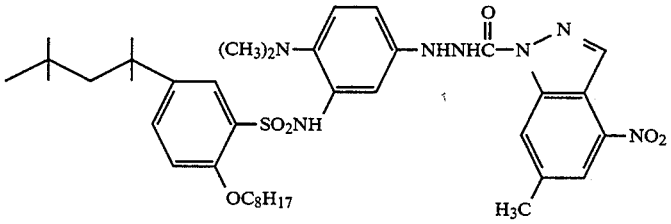
R-54
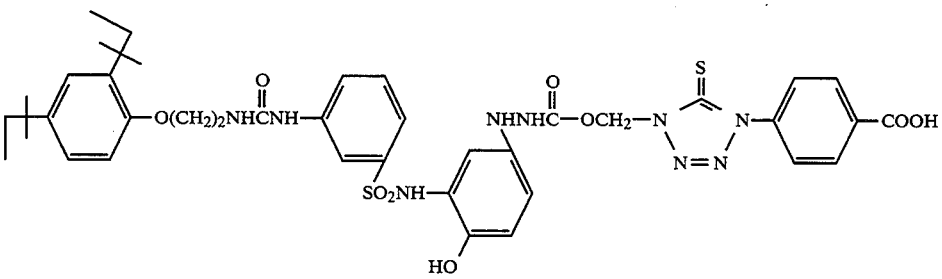

-continued

R-55

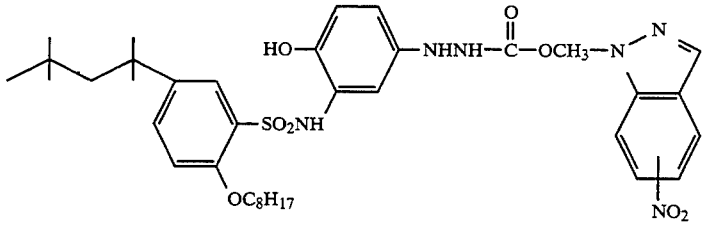

R-56

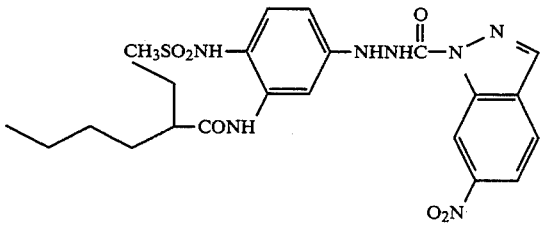

R-57

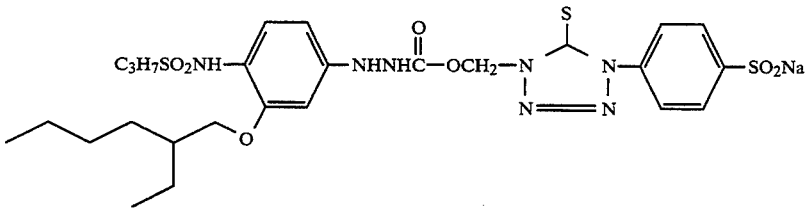

R-58

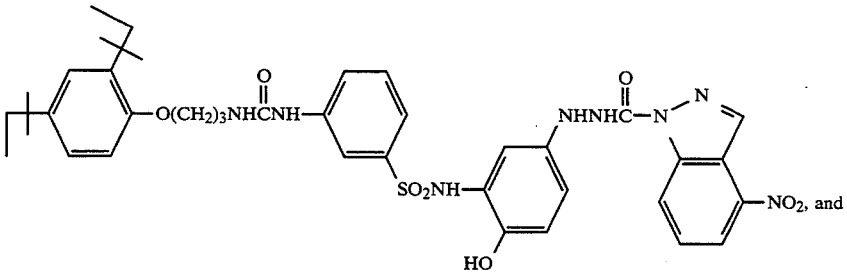

R-59

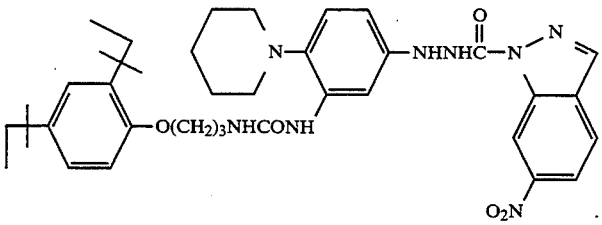

Synthetizing methods of the redox compounds used in the present invention are described, for example, in U.S. Pat. No. 4,684,604, Japanese Patent Application No. 98803/1988, U.S. Pat. Nos. 3,379,529, 3,620,746, 4,377,634 and 4,332,878 and Japanese Patent O.P.I. Publication Nos. 129536/1984, 153336/1981 and 153342/1981.

The redox compounds of the present invention are used in the range of $1.0\times10^{-4}$ to $5.0\times10^{-2}$ mol and preferably $1.0\times10^{-5}$ to $5.0\times10^{-2}$ mol per mol of silver halide. The redox compounds of the present invention can be used by dissolving in suitable water-soluble organic solvents such as alcohols (methanol, ethanol, propanol and fluorinated alcohol), ketones (acetone and methylethylketone), dimethylformaldehyde, dimethylsulfoxide and methylcellusolve.

In addition, the above-mentioned redox compounds can be used by dissolving in an oil such as dibutylphthalate, tricrezylphosphate, glycelyl triacetate or diethylphthalate by the use of an auxiliary solvent such as ethyl acetate and cyclohexanone by means of a well-known emulsification dispersion method so that an emulsification dispersant is prepared mechanically. Otherwise, they can be used by dispersing powder of the redox compound in water by the use of a ball mill, colloid mill or supersonic wave by means of a solid dispersion method.

It is preferable that a layer containing the redox compound of the present invention is provided on an upper layer of a light-sensitive emulsion layer containing a hydrazine nucleation agent. The layer containing the redox compounds of the present invention may contain light-sensitive or non-light-sensitive silver halide emulsion grains. In addition, it may have an auxiliary light-sensitive emulsion layer not containing the hydraiozne nucleation agent adjacent to the above-mentioned layer. An intermediate layer containing gelatin or a synthetic polymer (vinyl polyacetate and polyvinyl alcohol) may be provided between a layer containing the redox compound of the present invention and the light-sensitive emulsion layer containing the hydrazine nucleation agent.

As a developing agent used in the present invention, dihydroxybenzenes (for example, hydroquinone, chlorohydroquinone, bromohydroquinone, 2,3-dichlorohydroquinone, methylhydroquinone and isopropylhydroquinone 2,5-dimethylhydroquinone), 3-pyrazolidones (for example, 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone), aminophenols (for example, o-aminophenol, p-aminophenol, N-methyl-o-aminophenol, N-methyl-p-aminophenol and 2,4-diaminophenol), pyrogarol, ascorbic acid, 1-aryl-3-pyrazolines (for example, 1-(p-hydroxyphenyl)-3-aminopyrazoline, 1-(p-methylaminophenol)-3-aminopyrazoline, 1-(p-aminophenyl)-3-aminopyrazoline and 1-(p-amino-N-methylphenyl)-3-aminopyrazoline can be used singly or in combination. It is preferable to combine 3-pyrazolidones and dihydroxybenzenes or to combine aminophenols and dihydroxybenzenes. With regard to a developing agent, it is ordinarily preferable to be used in the range of 0.01 to 1.4 mol/l.

In the present invention, as a sulfite and a metabisulfite used as preservers, sodium sulfite, potassium sulfite, ammonium sulfite and sodium metabisulfite are cited. Sulfite is preferably 0.25 mol/l or more, and especially preferably 0.4 mol/l or more.

To the developing solution, when necessary, alkaline agents (sodium hydroxide and potassium hydroxide), pH buffer solutions (for example, carbonate salt, phosphate salt, borate salt, borate, acetic acid, citric acid and alkanol amine), dissolution aids (for example, polyethylene glycols and their ester and alkanolamine), sensitizers (for example, nonionic surfactants including polyoxyethylenes, anti-foaming agents, anti-foggants (for example, silver halides such as potassium bromide and sodium bromide, nitrobenzindazole, nitrobenzimidazole, benzotriazole, benzothiazole, tetrazoles and thiazoles), chelating agents (for example, ethylenediamine tetraacetic acid or its alkaline metallic salt, nitrolirotriacetic acid salt and polyphosphoric acis salt), development accelerators (for example, compounds described in U.S. Pat. No. 2,304,025 and Japanese Patent Publication No. 45541/1972) and hardeners (for example, glutric aldehyde or its bisulfite additive) can be added. It is preferable that pH of the development solution is regulated to 9.5 to 12.0.

As special form of photographic processing of the present invention, a developing agent may be incorporated in a light-sensitive material, for example in an emulsion layer and it is used for an activator processing solution wherein the light-sensitive material is processed in an alkaline aqueous solution. The above-mentioned photographic processing is often utilized as a rapid processing of the light-sensitive material in combination with silver salt stabilizing processing using thiocyanate salt. This can be utilized in such processing solution. In such a rapid processing, the effects of the present invention becomes noticeable.

As a fixing solution, those having ordinary composition can be used. The fixing solution is ordinarily an aqueous solution composed of a fixing agent and other components. pH is ordinarily 3.8 to 5.8. As a fixing agent, thiosulfate such as sodium thiosulfate, potassium thiosulfate and ammonium thiosulfate, thiocyanate salts such as sodium thiocyanate, potassium thiocyanate and ammonium thiocyanate and other organic sulfur compounds known as a fixing agent which can produce soluble stabilzing silver complex salt can be used.

To the fixing solution, there can be added water-soluble aluminium salt functioning as a hardener including aluminium chloride, aluminium sulfate and potash alum.

When necessary, the fixing solution can contain compounds such as a preserver (for example, sulfite and bisulfite), pH buffering agent (for example, acetic acid), pH regulators (for example, sulfuric acid) and chelating agents having hard-water-softening ability.

The developing solution may either be a mixture of solid components, organic aqueous solution containing glycol and amine and semi-kneaded high-viscosity liquid. In addition, they may be used as they are or after being diluted in using.

In the photogrpahic processing of the present invention, the developing temperature can be set either to the ordinary level of 20° to 30 ° C., or to the level of high temperature processing of 30° to 40° C.

It is preferable that the black-and-white photographic light-sensitive material of the present invention is processed by the use of an automatic processing machine. On such occasion, the light-sensitive material is processed while being a given amount of developing solution which is proportional to the area of light-sensitive material is replenished. The replenishing amount of developer is 250 ml or less in order to reduce the amount of effluent. It is preferably within the range of 75 ml or more and 200 ml or less per 1 $m^2$. When the replenishing amount of developing solution is less than 75 ml per 1 $m^2$, satisfactory photographic performance cannot be obtained due to the reduction of contrast.

In accordance with the demand of shortening development time, it is preferable, in the present invention, the total processing time (Dry to Dry) since the front edge of film is inserted to an automatic processing machine till the rear edge comes out of the drying zone is 20 to 60 seconds. The preferable development time is 6 to 18 seconds. Here, the total processing time includes time necessary for processing a black-and-white silver halide photographic light-sensitive material, and practically includes all of development step, fixing step, bleaching step, washing step, stabilizing step and drying step, in other words, time for Dry to Dry. When the total processing time is less than 20 seconds, satisfactory photographic performance cannot be obtained due to desensitization and reduction of contrast. In addition, the preferable processing time (Dry to Dry) is 30 to 60 seconds. To the developing solution of the present invention, in addition to the compounds of the present invention, inorganic development inhibitors such as bromo potassium, organic development inhibitors such as 5-methylbenzotriazole, 5-methylbenzimidazole, 5-nitroindazole, adenine, guanine, 1-phenyl-5-mercaptotetrazole, metallic ion scavengers such as ethylenediamine tetraacetic acid, development accelerators such as methanol, ethanol, benzylalcohol and polyalkyleneoxide, surfactants such as sodium alkylarylsulfonic acid, natural saponin, sugar or alkylester of the above-mentioned compounds, gulutaric aldehyde, formaline and glyoxal and ion-strength regulators such as sodium sulfate can be added.

In the developing solution used in the present invention, glycols such as diethylene glycol and triethylene glycol may be incorporated as an organic solvent. On the other hand, it is not preferable that alkanol amines as described in Japanese Patent O.P.I. Publication No. 106244/1981 is not contained.

In the silver halide emulsion (hereunder referred to as a silver halide emulsion or simply emulsion) used in the present invention, arbitrary silver halide used in ordinary silver halide emulsion such as silver bromide, silver iodobromide, silver iodochloride, silver chlorobromide, silver chloride can be used. The preferable are silver chloride, silver chlorobromide and silver iodochlorobromide wherein the content of silver chloride is 50 mol % or more.

In addition, a mono dispersed grain wherein a cariation coefficient which is represented by (standard coefficient of grain size)/(average value of grain size)×100 is 15% or less.

In the present invention, the amount of gelatin on the side of silver halide emulsion layer is preferably 3.0 g/m$^2$. In addition, when a silver halide grain is prepared, it is preferable to add $10^{-5}$ to $10^{-8}$ mol of rhodium salt per mol of silver.

To the silver halide emulsion of the present invention, various technologies and additives known in the art can be used. For example, to the silver halide photographic emulsion and backing layer of the present invention, various chemical sensitizers, color-tone agents, hardeners, surfactants, viscosity-increasing agents, plasticizers, anti-slip agents, development inhibitors, UV absorbers, anti-irrAdiation agent dyes, heavy metals and matting agents can be contained additionally by means of various methods. In addition, in the silver halide photographic emulsion and the backing layer, a polymer latex can be contained.

These additives are described in detail in Research Disclosure Volume 176, Item/7643 (December, 1978) and Volume 187, Item 8716 (November, 1979). The relevant points are shown collectively as follows.

| Additive | RD/7643 | RD/8716 |
|---|---|---|
| 1. Chemical sensitizer | page 23 | on page 648, at the right column |
| 2. Sensitivity enhancement agent | | on page 648, at the right column |
| 3. Spectral sensitizer | pp. 23 to 24 | page 648, at the right column to |
| Super sensitizer | | page 649, at the right column |
| 4. Whitening agent | | |

-continued

| Additive | RD/7643 | RD/8716 |
|---|---|---|
| 5. Anti-foggant and stabilizer | page 24 | page 649, at the right column |
| 6. Light-absorber, filter dye and UV absorber | pp. 24 to 25 | page 649, at the right column to |
| 7. Anti-stain agent | page 25 at the right column | page 650, at the left column to the right column |
| 8. Dye image stabilizer | page 25 | |
| 9. Hardener | page 26 | page 651, at the left column |
| 10. Binder | page 26 | page 651, at the left column |
| 11. Plasticizer, lubricant | page 27 | page 650, at the right column |
| 12. Coating aid, surface activator | pp. 26 to 27 | page 650, at the right column |
| 13. Anti-static agent | page 27 | page 650, at the right column |

As a support to be used for the silver halide photographic light-sensitive material of the present invention, polyester such as cellulose acetate, cellulose nitrate and polyethylene terphthalate, polyorephin such as polyethylene, polystyrene, baryta paper, papers wherein polyeorephin is coated, glass and metal are cited. These supports are provided with subbing if necessary.

EXAMPLE

Next, the present invention is explained in detail referring to Examples. However, the present invention is not limited thereto.

EXAMPLE 1

(Preparation of a support having an electroconductive layer)

After a subbed polyethylene terephthalate with a thickness of 100 μm was subjected to corona discharge, an anti-static solution having the following composition was coated using a roll fit coating pan and an air knife at a speed of 70 m/min. with the following added amount.

| | |
|---|---|
| Water-soluble electrocnductive polymer P | 0.6 g/m$^2$ |
| Hydrophobic polymer grain L | 0.4 g/m$^2$ |
| Polyethylene oxide compound Ao | 0.06 g/m$^2$ |
| Hardener E | 0.2 g/m$^2$ |

Thus-coated substrate was dried at 90° C. over a period of 2 min. and thereafter subjected to a thermal treatment at 140° C. for 90 sec. to prepare a support having on one side thereof a electroconductive layer.

Polymer P

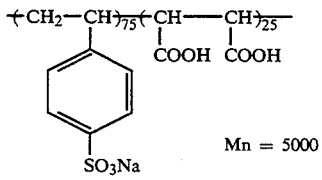

Mn = 5000

Polymer particle L

-continued

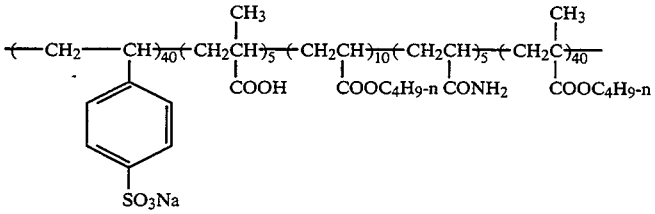

Compound Ao
$HO(CH_2CH_2O)_{15}H$

E

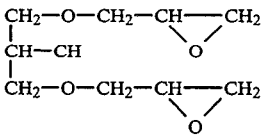

(Preparation of a silver halide emulsion)

A silver bromochloride (AgCi: 70 mol %, AgI: 0.5 mol %, and AgBr: 29.5 mol %) was prepared by simultaneous precipitation.

During the mixing step from the moment when 5% of the average grain size to be attained finally was formed till the average grain size to be attained finally, potassium hexabromo rhodate salt of $8\times10^{-7}$ mol per mol of silver and potassium hexachloro iridium salt of $8\times10^{-7}$ mol per mol of silver were added.

The resulting emulsion comprised cubic mono-dispersed grains having an average grain size of 0.20 μm (the variation coefficient of 9%). It was subjected to washing for desalting by means of a conventional method. pAg after being desalted at 40° C. was 8.0. Succeedingly, sensitizing dye D-1 of 200 mg per mol of silver and D-2 of 10 mg were added. In addition, a mixture of compounds [A], [B] and [C] was added to prepare emulsion A. Thereafter, sulfur sensitization was provided thereto.

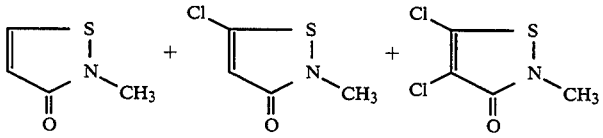

(A) + (B) + (C)

Sensitizing dye D-1

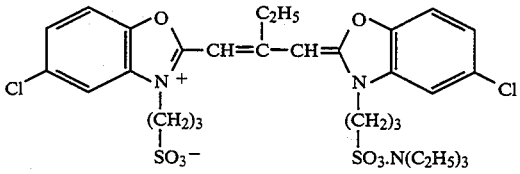

Sensitizing dye D-2

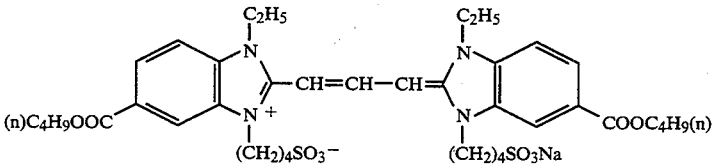

Formula (1) (Light-sensitive silver halide emulsion layer composition)

| | |
|---|---|
| Gelatin | 1.2 g/m² |
| Silver halide emulsion A in terms of silver amount | 3.2 g/m² |
| Stabilizer: 4-methyl-6-hydroxy-1,3,3a,7-tetrazaindene | 30 mg/m² |
| Anti-foggant: | |
| 5-nitroindazole | 10 mg/m² |
| 1-phenyl-5-mercapto tetrazole | 5 mg/m² |
| Surfactant: | |
| Sodium dodecyl benzene sulfonic acid | 0.1 g/m² |
| S-1 | 8 mg/m² |

-continued

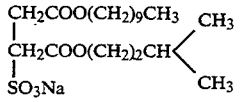

Hydrazine derivative of the present invention

| | |
|---|---|
| C-7 | 15 mg/m$^2$ |
| C-8 | 2 mg/m$^2$ |
| Latex polymer: Lx-1 | 1 g/m$^2$ |

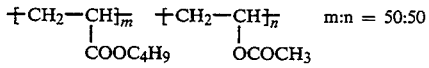

m:n = 50:50

| | |
|---|---|
| Polyethylene glycol (M.W.: 4000) | 0.1 g/m$^2$ |
| Hardener: HA-1 | 60 mg/m$^2$ |

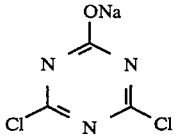

Formula (2) (Protective layer composition)

| | |
|---|---|
| Gelatin | 0.5 g/m$^2$ |
| Surfactant: S-2 | 10 g/m$^2$ |

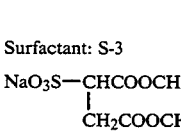

| | |
|---|---|
| Surfactant: S-3 | 10 mg/m$^2$ |

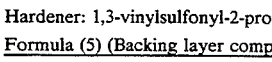

| | |
|---|---|
| Matting agent: Monodispersed silica having an average grain size of 3.5 μm | 3 mg/m$^2$ |
| Hardener: 1,3-vinylsulfonyl-2-propanol | 40 mg/m2 |

Formula (5) (Backing layer composition)

(a) 30 mg/m$^2$

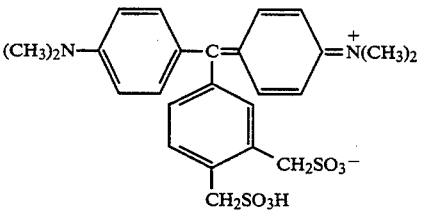

(b) 75 mg/m$^2$

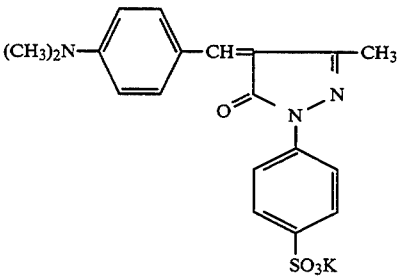

(c) 30 mg/m$^2$

-continued

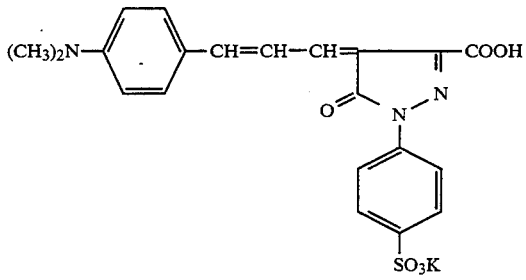

| | |
|---|---|
| Gelatin | 2.4 g/m$^2$ |
| Surfactant: | |
| Sodium dodecyl benzene sulfonic acid | 0.1 g/m$^2$ |
| S-1 | 6 mg/m$^2$ |
| Colloidal silica | 100 mg/m$^2$ |
| Hardener: E | 55 mg/m$^2$ |
| Formula (6) (Backing protective layer composition) | |
| Gelatin | 1 g/m$^2$ |
| Matting agent: Mono dispersed polymethyl methacrylate having an average grain size of 5.0 μm | 50 mg/m$^2$ |
| Surfactant: S-2 | 10 mg/m$^2$ |
| Hardener: | |
| Glyoxal | 25 mg/m$^2$ |
| HA-1 | 35 mg/m$^2$ |
| Formula (3) Hydrophilic colloidal layer 1 | |
| Gelatin | 0.5 g/m$^2$ |
| Surfactant: S-1 | 9 mg/m$^2$ |
| Formula (4) Hydrophilic colloidal layer | |
| Gelatin | 0.7 g/m$^2$ |
| Silver halide emulsion A | 0.3 g/m$^2$ |
| Stabilizer: 4-methyl-6-hydroxy-1,3,3a,7-tetrazaindene | 30 mg/m$^2$ |
| Anti-foggant: | |
| 5-nitroindazole | 10 mg/m$^2$ |
| 1-phenyl-5-mercaptotetrazole | 5 mg/m$^2$ |
| Surfactant: S-1 | 8 mg/m$^2$ |
| Redox compound of the present invention | $3.0 \times 10^{-5}$ mol/m$^2$ |

On an opposite side on a support to an electroconductive layer, the following layers were coated in this order. On the electroconductive layer, a backing layer of Formula (5) and a backing protective layer of Formula (6) were coated in this order.

(1st layer) Light-sensitive silver halide emulsion layer (2nd layer) Hydrophilic colloidal layer 1 of Formula (3)

(3rd layer) Hydrophilic colloidal layer 2 of Formula (4)

(4th layer) Protective layer of Formula (2)

The resulting samples were evaluated by the following method.

[Evaluation of silver sludge (silver stain)]

The resulting samples were subjected to exposure to light for $10^{-6}$ second using HeNe lazer and photographic processing by means of an automatic processing machine GR-26SR for rapid processing use produced by KONICA CORPORATION wherein a developing solution and a fixing solution each having the following composition were charged while replenishing the developing solution of 160 cc and the fixing solution of 190 cc per 1 m$^2$ under the following conditions. Processing of 200 sheets of a full size paper per day was run for 3 days. After running, an unexposed film having the full size was photographically processed in the automatic processing machine, and roller streak-like silver sludge observed on the surface of a film was evaluated visually. In addition, after the processing was run for 3 days in the above-mentioned manner, the automatic processing machine was stopped. After 24 hours, black silver sludge occurred in the devleoping tank of the automatic processing machine was evaluated visually.

Rank 5: No silver sludge occured.

Rank 4: Silver sludge occurred slightly.

Rank 3: Silver sludge occurred a little considerably.

Rank 2: Silver sludge occurred in a large amount.

Rank 1: Silver sludge occurred in a quite large amount.

[Evaluation of photographic performance]

A wedge was contacted on the resulting samples, and they were subjected to exposure to light for $10^{-6}$ second with HeNe laser. Then, the resulting samples were processed with a developing solution aged for 10 days having the following composition and an automatic processing machine GR-26SR for rapid processing use produced by KONICA CORPORATION wherein a fixing solution was also charged.

The density of the resulting sample was measured with an optical densitometer Konica PDA-65. The sensitivity was shown by a relative value wherein the sensitivity at the density of 2.5 of Sample No. 1 was defined to be 100. In addition, tangent between density 0.1 and density 2.5 was shown as $\gamma$. When $\gamma$ value was less than 8.0, contrast was insufficient so that it could not be practically used.

[Evaluation of black spot]

An unexposed portion of the resulting sample already subjected to developing processing was visually evaluated using a 40-times magnifier. A sample having no black spots at all was ranked as the highest "5". Depending upon the degree of occurrence of black spots, ranks were lowered "4", "3", "2" and "1". Ranks "2"and "1" are not at practically desirable level.

[Composition of a developing solution 1]

| | |
|---|---|
| Potassium sulfite | 90.0 g |
| Hydroquinone | 20.0 g |
| 4-methyl-4-hydroxymethyl-1-phenyl-3-pyrazolidone | 1.0 g |
| Disodium ethylenediamine tetraacetic acid | 2.0 g |
| Potassium carbonate | 12.0 g |
| Potassium bromide | 5.0 g |
| 5-methylbenzotriazole | 0.3 g |
| Diethyleneglycol | 25.0 g |

Water was added to make 1l, and pH was adjusted to 10.6 with potassium hydroxide.

-continued

| | |
|---|---|
| Sulfuric acid (an aqueous 50% W/V solution) | 2.0 g |
| Ammonium sulfate (an aqueous 8.1% W/V solution wherein in conversion to $Al_2O_3$ | 8.5 g |

The fixing solution was used after preparing 1 l thereof. pH of this fixing solution was adjusted to be 4.8.

(Conditions of photographic processing)

| (Step) | (Temperature) | (Time) |
|---|---|---|
| Develping | 38° C. | 12 sec. |
| Fixing | 35° C. | 10 sec. |
| Washing | 30° C. | 10 sec. |
| Drying | 50° C. | 13 sec. |
| Total | | 45 sec. |

The results thereof are shown in Table 1.

TABLE 1

| No. | Constitution of Redox compound | Compound [1] Constitution | Compound [1] Added amount mg/l | Silver sludge (siver dirt) Dirt on the surface of film | Silver sludge (silver dirt) Dirt of a tank for developing solution | Relative sensitivity | γ | Black spot | Note |
|---|---|---|---|---|---|---|---|---|---|
| 1 | — | — | — | 1 | 1 | 100 | 12 | 1 | Comparative |
| 2 | R-4 | — | — | 2 | 2 | 95 | 11.5 | 3 | Comparative |
| 3 | R-4 | Comparative A | 200 | 3 | 3 | 45 | 4.5 | 3 | Comparative |
| 4 | R-4 | Comparative B | 200 | 3 | 3 | 50 | 4.5 | 3 | Comparative |
| 5 | R-4 | Comparative C | 200 | 2 | 2 | 55 | 4 | 3 | Comparative |
| 6 | R-4 | 1-6 | 200 | 5 | 5 | 95 | 11.5 | 5 | Invention |
| 7 | R-28 | 1-6 | 200 | 5 | 5 | 95 | 11 | 5 | Invention |
| 8 | R-37 | 1-6 | 200 | 5 | 5 | 95 | 11.5 | 5 | Invention |
| 9 | R-46 | 1-8 | 200 | 5 | 5 | 90 | 11.5 | 5 | Invention |
| 10 | R-4 | 1-10 | 200 | 5 | 5 | 95 | 12 | 5 | Invention |
| 11 | R-51 | 1-10 | 200 | 5 | 5 | 95 | 12 | 5 | Invention |
| 12 | R-4 | 1-20 | 200 | 5 | 5 | 90 | 11.5 | 5 | Invention |
| 13 | R-46 | 1-24 | 200 | 5 | 4 | 90 | 12 | 5 | Invention |
| 14 | R-51 | 1-28 | 200 | 4 | 4 | 90 | 12 | 4 | Invention |
| 15 | R-54 | 1-28 | 200 | 4 | 3 | 90 | 12 | 4 | Invention |
| 16 | R-4 | 1-30 | 200 | 4 | 3 | 90 | 12 | 4 | Invention |
| 17 | R-28 | 1-32 | 200 | 4 | 3 | 95 | 12 | 4 | Invention |
| 18 | R-4 | 1-33 | 200 | 5 | 5 | 95 | 12 | 5 | Invention |
| 19 | R-54 | 1-33 | 200 | 5 | 5 | 95 | 12 | 5 | Invention |

Comparative A

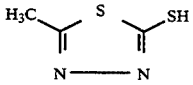

Comparative B

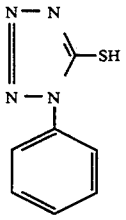

Comparative C

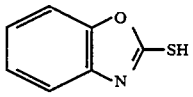

[Formula of fixing solution]

| | |
|---|---|
| Ammonium thiosulfate (72.5% W/V aqueous solution) | 200 ml |
| Sodium sulfite | 17 g |
| Sodium acetate trihydrate | 6.5 g |
| Borate | 6.0 g |
| Sodium citric acid dehydrate | 2.0 g |
| (Composition B) | |
| Pure water (ion-exchanged water) | 17 ml |

From the results of Table 1, it is shown that the samples of the present invention achieved high sensitivity and high γ value, less frequency of the occurrence of black spots and stains on the surface of a film and in the developing solution tank due to silver sludge.

EXAMPLE 2

Example 2 was conducted in the same manner as in Example 1 except that compounds represented by Formula [2] was used in place of compounds represented by Formula [1] added to the developing solution.

TABLE 2

| No. | Constitution of Redox compound | Compound [2] Constitution | Compound [2] Added amount mol/l | Silver sludge (silver dirt) Dirt on the surface of film | Silver sludge (silver dirt) Dirt of a tank for developing solution | Relative sensitivity | γ | Black spot | Note |
|---|---|---|---|---|---|---|---|---|---|
| 1 | — | — | — | 1 | 1 | 100 | 12 | 1 | Comparative |
| 2 | R-4 | — | — | 2 | 2 | 95 | 11.5 | 3 | Comparative |
| 3 | R-4 | Comparative A | 200 | 3 | 3 | 45 | 4.5 | 3 | Comparative |
| 4 | R-4 | Comparative B | 200 | 3 | 3 | 50 | 4.5 | 3 | Comparative |
| 5 | R-4 | Comparative C | 200 | 2 | 2 | 55 | 4 | 3 | Comparative |
| 6 | R-4 | 2-35 | 200 | 5 | 5 | 95 | 12 | 5 | Invention |
| 7 | R-28 | 2-35 | 200 | 5 | 5 | 95 | 12 | 5 | invention |
| 8 | R-37 | 2-35 | 200 | 5 | 5 | 90 | 12 | 5 | invention |
| 9 | R-46 | 2-4 | 200 | 5 | 5 | 90 | 11.5 | 5 | Invention |
| 10 | R-4 | 2-7 | 200 | 4 | 5 | 95 | 11.5 | 4 | Invention |
| 11 | R-51 | 2-12 | 200 | 5 | 5 | 95 | 11 | 5 | Invention |
| 12 | R-4 | 2-14 | 200 | 5 | 5 | 95 | 12 | 5 | Invention |
| 13 | R-46 | 2-17 | 200 | 4 | 5 | 90 | 12 | 5 | Invention |
| 14 | R-51 | 2-24 | 200 | 5 | 5 | 95 | 12 | 5 | invention |
| 15 | R-54 | 2-27 | 200 | 5 | 5 | 95 | 11.5 | 5 | Invention |
| 16 | R-4 | 2-29 | 200 | 5 | 5 | 95 | 12 | 5 | Invention |
| 17 | R-28 | 2-32 | 200 | 4 | 4 | 90 | 12 | 4 | Invention |
| 18 | R-4 | 2-37 | 200 | 4 | 4 | 90 | 12 | 4 | Invention |
| 19 | R-54 | 2-38 | 200 | 5 | 5 | 95 | 12 | 5 | Invention |

From the results of Table 2, the same results as in Example 1 were obtained.

EXAMPLE 3

Example 3 was conducted in the same manner as in Example 1 except that compounds represented by Formula [3] was used in place of compounds represented by Formula [1] added to the developing solution.

TABLE 3

| No. | Constitution of Redox compound | Compound [3] Constitution | Compound [3] Added amount mg/l | Silver sludge (silver dirt) Dirt on the surface of film | Silver sludge (silver dirt) Dirt of a tank for developing solution | Relative sensitivity | γ | Black spot | Note |
|---|---|---|---|---|---|---|---|---|---|
| 1 | — | — | — | 1 | 1 | 100 | 12 | 1 | Comparative |
| 2 | R-4 | — | — | 2 | 2 | 95 | 11.5 | 3 | Comparative |
| 3 | R-4 | Comparative A | 200 | 3 | 3 | 45 | 4.5 | 3 | Comparative |
| 4 | R-4 | Comparative B | 200 | 3 | 3 | 50 | 4.5 | 3 | Comparative |
| 5 | R-4 | Comparative C | 200 | 2 | 2 | 55 | 4 | 3 | Comparative |
| 6 | R-4 | 3-b-7 | 200 | 5 | 5 | 95 | 11.5 | 5 | Invention |
| 7 | R-28 | 3-b-7 | 200 | 5 | 5 | 95 | 12 | 5 | Invention |
| 8 | R-37 | 3-b-7 | 200 | 5 | 5 | 95 | 12 | 5 | Invention |
| 9 | R-46 | 3-a-2 | 200 | 4 | 4 | 95 | 11.5 | 4 | Invention |
| 10 | R-4 | 3-a-2 | 200 | 5 | 5 | 90 | 12 | 5 | Invention |
| 11 | R-51 | 3-a-13 | 200 | 5 | 5 | 95 | 12 | 5 | Invention |
| 12 | R-4 | 3-a-19 | 200 | 5 | 5 | 95 | 12 | 5 | Invention |
| 13 | R-46 | 3-a-28 | 200 | 5 | 5 | 90 | 12 | 4 | Invention |
| 14 | R-51 | 3-b-11 | 200 | 5 | 5 | 90 | 11.5 | 5 | Invention |
| 15 | R-54 | 3-b-22 | 200 | 4 | 4 | 95 | 11.5 | 4 | Invention |
| 16 | R-4 | 3-b-22 | 200 | 5 | 5 | 95 | 12 | 5 | Invention |
| 17 | R-28 | 3-b-25 | 200 | 5 | 5 | 95 | 12 | 5 | Invention |
| 18 | R-4 | 3-b-28 | 200 | 5 | 5 | 95 | 12 | 5 | Invention |
| 19 | R-54 | 3-b-30 | 200 | 5 | 5 | 95 | 12 | 5 | Invention |

From the results of Table 3, the same results as in Example 1 could be obtained.

What is claimed is:

1. A method of processing, by use of an automatic processor, a black-and-white silver halide photographic light-sensitive material comprising a support having thereon photographic component layers comprising a light-sensitive silver halide emulsion layer and nonlight-sensitive hydrophilic colloid layer, at least one of the component layers containing a hydrazine compound and a redox compound capable of releasing an inhibitor upon oxidation, the method comprising the steps of:

exposing the photographic material to light, developing the exposed photographic material with a developer, said developer being replenished by a developer replenisher at a rate of not more than 200 ml per $m^2$ of the photographic material, and fixing the developed photographic material with a fixer, wherein said developer has a pH of 9.5 to 10.8 and contains a compound represented by the following formulas (2) or (3),

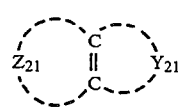

Formula 2

-continued

Formula 3

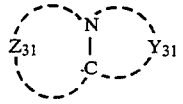

wherein Z represents an alkyl, an aryl or heterocyclic group, each of which has at least one group selected from hydroxy, $—SO_3M^1$, $—COOM^1$, an amino group and an ammonio group, or a group having at least one of hydroxy, $SO_3M^1$, $COOM^1$, an amino group and an ammonio group, in which $M_1$ represents a hydrogen atom, an alkali metal atom or an ammonium group; M represents a hydrogen atom, an alkali metal atom or an amidino group; $Y_{21}$ and $Z_{21}$ each represent an atomic group necessary to form an unsaturated 5- or 6-membered ring, and thus formed rings contain together three or more nitrogen atoms, being substituted by a mercapto group; and $Z_{31}$ each represent an atomic group necessary to form an unsaturated 5- or 6-membered ring, and thus formed rings contain together three or more nitrogen atoms, being substituted by a mercapto group.

2. The processing method of claim 1, wherein said compound represented by Formula [2] is represented by the following formulas [2-a], [2-b], [2-c], [2-d], [2-e] or [2-f], Formula [2-a]

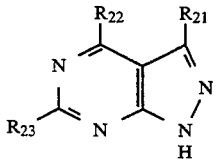

Formula [2-b]

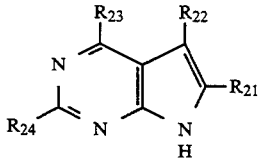

Formula [2-c]

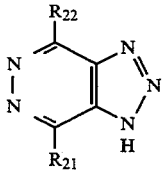

Formula [2-d]

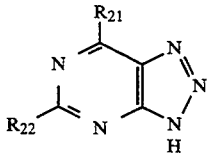

Formula [2-e]

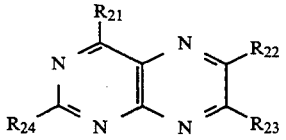

wherein $R_{21}$ through $R_{24}$ each represent a hydrogen atom, a halogen atom, hydroxy, a mercapto group, a sulfo group, an amino group, a carboxy group, a carbamoyl group, a mercapto group, an alkyl group, an alkoxy group or an aryl group, provided that in Formula [2-a], at least one of $R_{21}$, $R_{22}$ and $R_{23}$ is a mercapto group; in Formulas [2-b] and [2-e], at least one of $R_{21}$, $R_{22}$, $R_{23}$ and $R_{24}$ is a mercapto group; and in Formulas [2-c] and [2-d], at least one of $R_{21}$ and $R_{22}$ is a mercapto group, Formula [2-f]

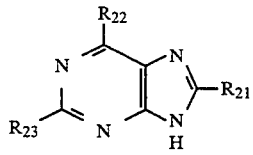

wherein $R_{21}$, $R_{22}$ and $R_{23}$ each represent a hydrogen atom, hydroxy, a mercapto group, a sulfo group, an amino group, a carboxy group, an alkyl group or an alkoxy group, provided that at least one of $R_{21}$, $R_{22}$ and $R_{23}$ is a mercapto group.

3. The processing method of claim 1, wherein said compound represented by Formula [3] is representred by Formulas [3-a] or [3-b], Formula [-a]

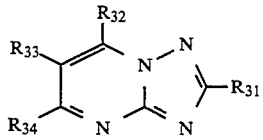

Formula [3-b]

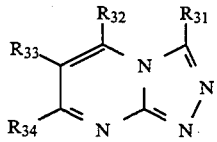

wherein $R_{31}$ through $R_{34}$ a hydrogen atom, $—SM_{31}$, hydroxy, $—COOM_{32}$, an amino group, $—SO_3M_{33}$, an alkyl group or an alkoxy group; $M_{31}$, $M_{32}$ and $M_{33}$ represent a hydrogen atom, an alkali metal atom or an ammonium group.

4. The processing method of claim 1, wherein said compound represented by Formulas [2] or [3] is contained in an amount of $10^{-5}$ to 10−1 mol per liter of developer.

5. The processing method of claim 1, wherein said hydrazine compound is represented by the following formula [H], Formula [H]

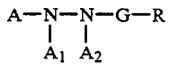

wherein A represents an aryl group or a heterocyclic group containing an oxygen or sulfur atom; G represents

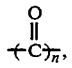

a sulfonyl group, a sulfoxy group,

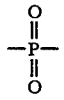

or an iminomethylene group; n is 1 or 2; both of $A_1$ and $A_2$ are a hydrogen atom, or either of $A_1$ and $A_2$ is hydrogen and another of them is an acyl group or an alkylsulfonyl group; R represents a hydrogen atom, an alkyl group, an aryl group, an alkoxy group, an aryloxy group, an amino group, a carbamoyl group, an oxycarbonyl group or —O—$R_2$ in which $R_2$ represents an alkyl group or a saturated heterocyclic group.

6. The processing method of claim 5, wherein said hydrazine compound is represented by the following formulas [H-a] or [H-b],

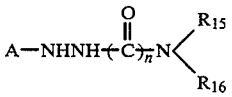

Formula [H-a]

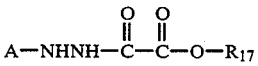

Formula [H-b]

wherein A represents an aryl group or a hetrocyclic group containing an oxygen or sulfur atom; n is an integer of 1 or 2; $R_{15}$ and $R_{16}$ independently represents a hydrogen atom, an alkyl group, an alkenyl group, an alkynyl group, an aryl group, a heterocyclic group, a hydroxy group, an alkoxy group, an alkenyloxy group, an alkynyloxy group, an aryloxy group or a heterocyclic-oxy group, and $R_{15}$ and $R_{16}$ may combine with each other to form a ring containing a nitrogen atom, provided that when n is 2, at least one of $R_{15}$ and $R_{16}$ is an alkenyl group, an alkynyl group, an aryl group, a saturated heterocyclic group, a hydroxy group, an alkoxy group, an alkenyloxy group, an alkynyloxy group, an aryloxy group or a heterocyclic-oxy group; $R_{17}$ represents an alkynyl group or saturated heterocyclic group.

7. The processing method of claim 5, wherein said hydrazine compound is contained in an amount of $1\times10^{-6}$ to $1\times10^{-1}$ mol per mol of silver halide.

8. The processing method of claim 1, wherein said redox compound is contained in amount of $1\times10^{-4}$ to $5\times10-2$ mol per mol of silver halide.

9. The processing method of claim 1, wherein said redox compound is represented by the following formula (R),

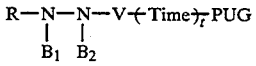

Formula (R)

wherein R is an aliphatic group, aromatic group or heterocyclic group, both of $B_1$ and $B_2$ are a hydrogen atom or a sulfinic acid radical substituent, or either of $B_1$ and $B_2$ is a hydrogen atom and another of them is a sulfinic acid radical substituent or —C(O)—$R_o$, in which $R_o$ represents an alkyl group, an alkenyl group, an aryl group, an alkoxy group or an aryloxy group; V represents a carbonyl group, —C(O)C(O)—, a sulfonyl group, a sulfoxy group, an iminomethylene group, a thiocarbonyl group or —P(O)($R_{14}$)—$R_1$, in which $R_1$ is an alkoxy or aryloxy group; Time represents a bivalent linkage group; t is 0 or 1; PUG represents a photographically useful group.

10. The processing method of claim 1, wherein said hydrazine compound is contained in a silver halide emulsion layer or a layer adjacent to the silver halide emulsion layer.

11. The processing method of claim 1, wherein at least one of the component layers contains a nucleation-accelerating compound.

12. The processing method of claim 1, wherein said developer is replenished by a developer replenisher at a rate of 75 to 200 ml per $m^2$ of the photographic material.

13. The processing method of claim 1, wherein a total processing time of the photographic material is within the range of 20 to 60 seconds.

14. The processing method of claim 1, wherein the amount of gelatin coated on the side having the silver halide emulsion layer is not more than 3.0 g/$m^2$.

15. A method of processing, by use of an automatic processor, a black-and-white silver halide photographic light-sensitive material comprising a support having thereon photographic component layers comprising a light-sensitive silver halide emulsion layer and nonlight-sensitive hydrophilic colloid layer, at least one of the component layers containing $1\times10^{-6}$ to $1\times10^{-1}$ mole per mole of silver halide of a hydrazine compound and $1\times10^{-4}$ to $5\times10^{-2}$ mole per mole of silver halide of a redox compound capable of releasing an inhibitor upon oxidation, the method comprising the steps of:

exposing the photographic material to light, developing the exposed photographic material with a developer, said developer being replenished by a developer replenisher at a rate of not more than 200 ml per $m^2$ of the photographic material, and fixing the developed photographic material with a fixer, wherein said developer has a pH of 9.5 to 10.8 and contains $10^{-5}$ to $10^{-1}$ mole per liter of developer of a compound represented by the following formulas (2-a), (2-b), (2-c), (2-d), (2-e), (2-f), (3-a) or (3-b):

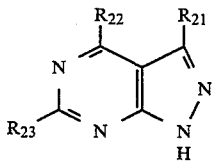

Formula (2-a)

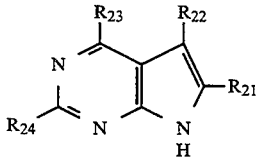

Formula (2-b)

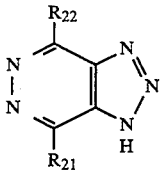

Formula (2-c)

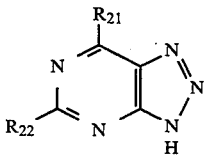

Formula (2-d)

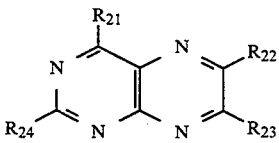

Formula (2-e)

wherein $R_{21}$ through $R_{24}$ each represent a hydrogen atom, a halogen atom, hydroxy, a mercapto group, a sulfo group, an amino group, a carboxy group, a carbamoyl group, a mercapto group, an alkyl group, an alkoxy group or an aryl group, provided that in Formula (2-a), am least one of $R_{21}$, $R_{22}$ and $R_{23}$ is a mercapto group; in Formulas (2-b) and 2-e), at least one of $R_{21}$, $R_{22}$, $R_{23}$ and $R_{24}$ is a mercapto group; and in Formulas (2-c) and (2-d), at least one of $R_{21}$ and $R_{22}$ is a mercapto group;

Formula (2-f)

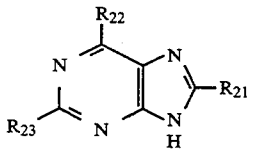

wherein $R_{21}$, $R_{22}$ and $R_{23}$ each represent a hydrogen atom, hydroxy, a mercapto group, a sulfo group, an amino group, a carboxy group, an alkyl group or an alkoxy group, provided least one of $R_{21}$, $R_{22}$ and $R_{23}$ is a mercapto group;

Formula (3-a)

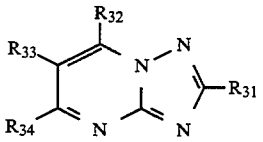

Formula (3-b)

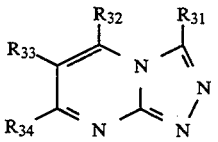

wherein $R_{31}$ through $R_{34}$ a hydrogen atom, —$SM_{31}$, hydroxy, —$COOM_{32}$, an amino group, —$SO_3M_{33}$, an alkyl group or an alkoxy group; $M_{31}$, $M_{32}$ and $M_{33}$ represent a hydrogen atom, an alkali metal atom or an ammonium group.

16. A method of processing, by use of an automatic processor, a black-and-white silver halide photographic light-sensitive material comprising a support having thereon photographic component layers comprising a light-sensitive silver halide emulsion layer and nonlight-sensitive hydrophilic colloid layer, at least one of the component layers containing a hydrazine compound in an amount of $1\times10^{-6}$ to $1\times10^{-1}$ mole per mole of silver halide and a redox compound capable of releasing an inhibitor upon oxidation, the method comprising the steps of:

exposing the photographic material to light, developing the exposed photographic material with a developer, said developer being replenished by a developer replenisher at a rate of 75 to 200 ml per $m^2$ of the photographic material, and fixing the developed photographic material with a fixer, wherein said developer has a pH of 9.5 to 10.8 and contains $10^{-5}$ to $10^{-1}$ mole per liter of developer of a compound represented by the following formulas (2-a), (2-b), (2-c), (2-d), (2-e), (2-f), (3-a) or (3-b):

Formula (2-a)

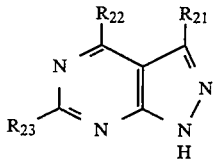

Formula (2-b)

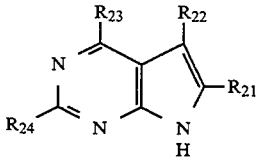

Formula (2-c)

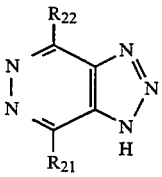

Formula (2-d)

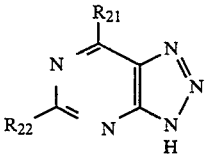

Formula (2-e)

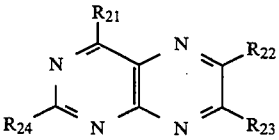

wherein $R_{21}$ through $R_{24}$ each represent a hydrogen atom, a halogen atom, hydroxy, a mercapto group, a sulfo group, an amino group, a carboxy group, a carbamoyl group, a mercapto group, an alkyl group, an alkoxy group or an aryl group, provided that in Formula (2-a), at least one of $R_{21}$, $R_{22}$ and $R_{23}$ is a mercapto group; in Formulas (2-b) and (2-e), at least one of $R_{21}$, $R_{22}$, $R_{23}$ and $R_{24}$ is a mercapto group; and in Formulas (2-c) and (2-d), at least one of $R_{21}$ and $R_{22}$ is a mercapto group;

Formula (2-f)

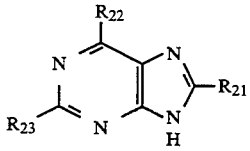

wherein $R_{21}$, $R_{22}$ and $R_{23}$ each represent a hydrogen atom, hydroxy, a mercapto group, a sulfo group, an amino group, a carboxy group, an alkyl group or an alkoxy group, provided that at least one of $R_{21}$, $R_{22}$ and $R_{23}$ is a mercapto group;

Formula (3-a)

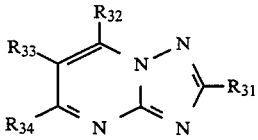

-continued

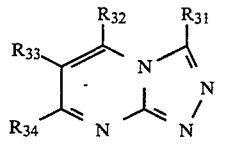

Formula (3-b)

wherein $R_{31}$ through $R_{34}$ a hydrogen atom, —$SM_{31}$, hydroxyl, —$COOM_{32}$, an amino group, —$SO_3M_{33}$, an alkyl group or an alkoxy group; $M_{31}$, $M_{32}$ and $M_{33}$ represent a hydrogen atom, an alkali metal atom or an ammonium group;

said hydrazine compound is represented by the following formula (H-a) or (H-b);

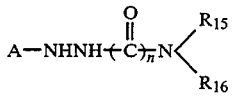

Formula (H-a)

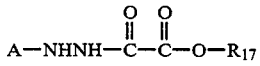

Formula (H-b)

wherein A represents an aryl group or a hetrocyclic group containing an oxygen or sulfur atom; n is an integer of 1 or 2; $R_{15}$ and $R_{16}$ independently represents a hydrogen atom, an alkyl group, an alkenyl group, an alkynyl group, an aryl group, a heterocyclic group, a hydroxy group, an alkoxy group, an alkenyloxy group, an alkynyloxy group, an aryloxy group or a heterocyclic-oxy group, and $R_{15}$ and $R_{16}$ may combine with each other to form a ring containing a nitrogen atom, provided when n is 2, at least one of $R_{15}$ and $R_{16}$ is an alkenyl group, an alkynyl group, an aryl group, a saturated heterocyclic group, a hydroxy group, an alkoxy group, an alkenyloxy group, an alkynyloxy group, an aryloxy group or a heterocyclic-oxy group; $R_{17}$ represents an alkynyl group or saturated heterocyclic group;

said redox compound is represented by the following formula (R)

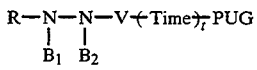

Formula (R)

wherein R is an aliphatic group, aromatic group or heterocyclic group, both of $B_1$ and $B_2$ are a hydrogen atom or a sulfinic acid radical substituent, or either of $B_1$ and $B_2$ is a hydrogen atom and another of them is a sulfinic acid radical substituent or —C(O)—$R_o$, in which $R_o$ represents an alkyl group, an alkenyl group, an aryl group, an alkoxy group or an aryloxy group; V represents a carbonyl group, —C(O)C(O)—, a sulfonyl group, a sulfoxy group, an iminomethylene group, a thiocarbonyl group or —P(O)($R_{14}$)—$R_1$, in which $R_1$ is an alkoxy or aryloxy group; Time represents a bivalent linkage group; t is 0 or 1; PUG represents a photographically useful group.

17. The processing method of claim 9, wherein said redox compound is selected from the group consisting of

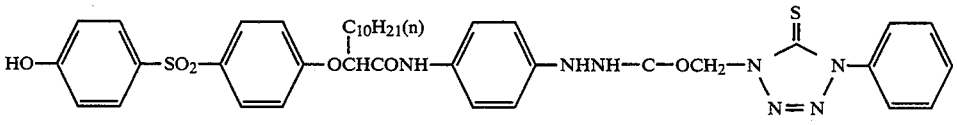

R-1

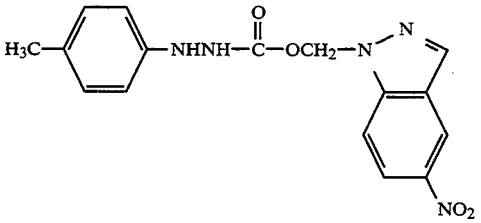

R-2

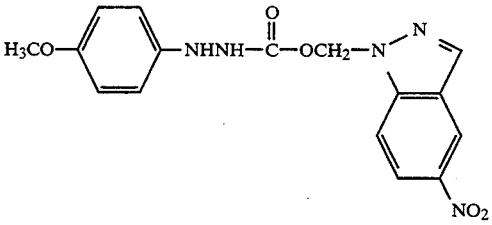

R-3

-continued
R-4
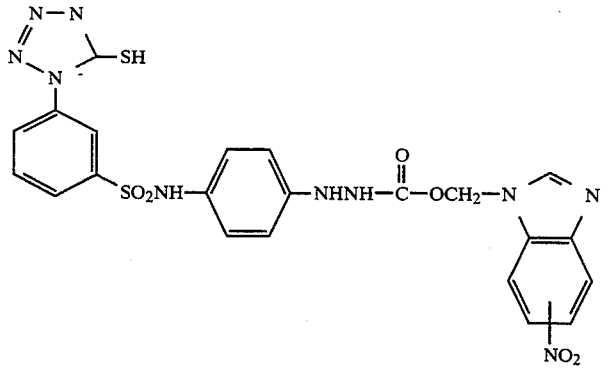
R-5
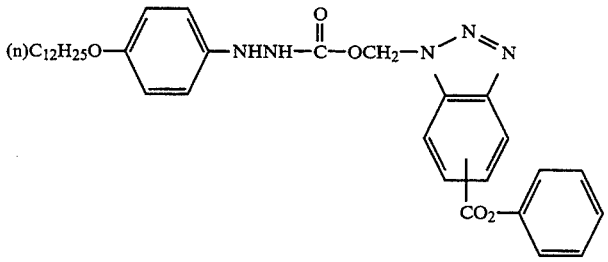
R-6
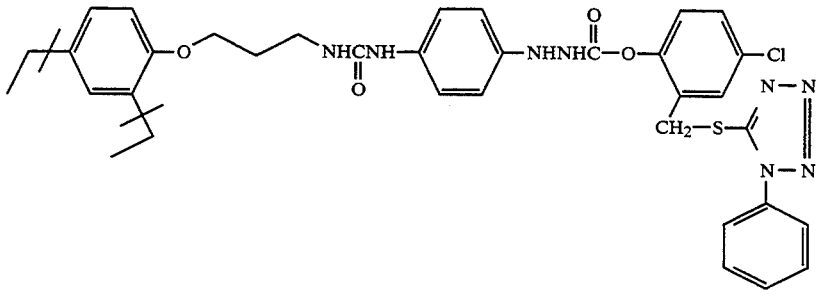
R-7
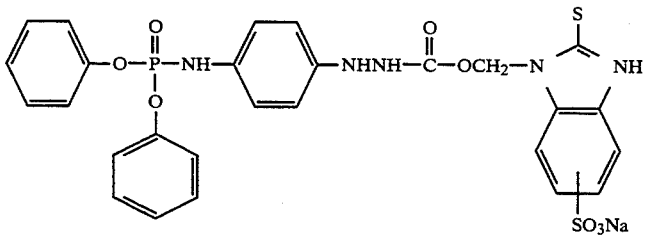
R-8
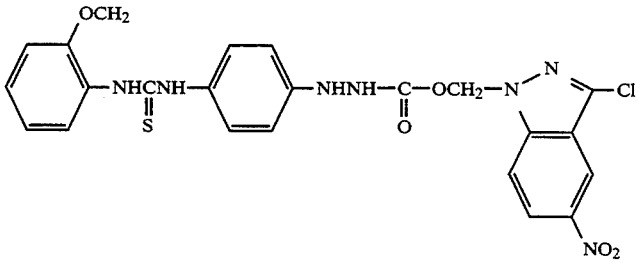
R-9
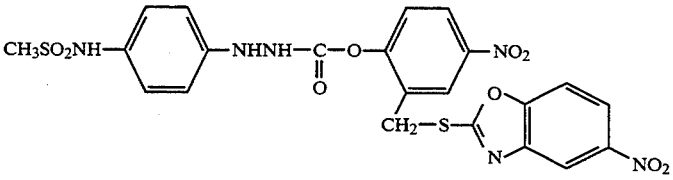

-continued
R-10
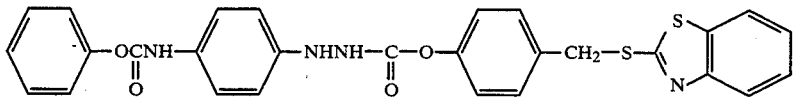
R-11
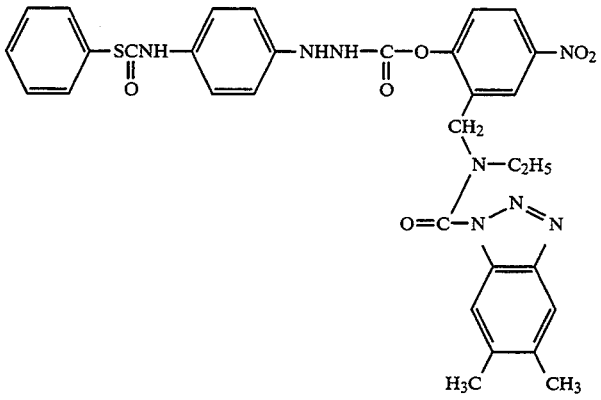
R-12
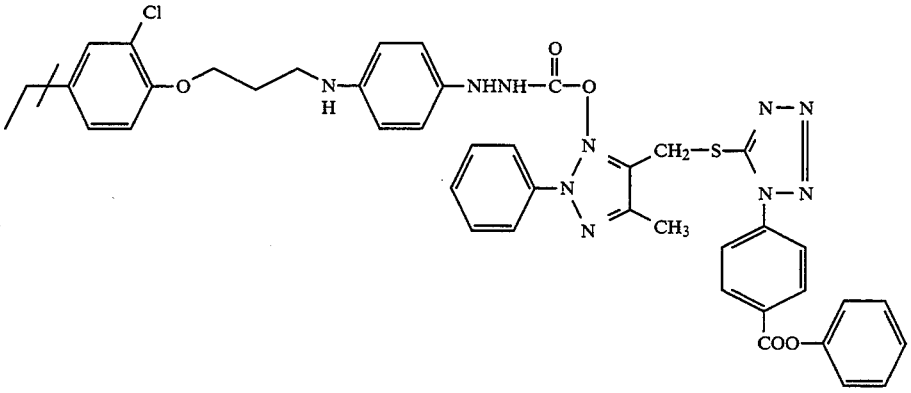
R-13
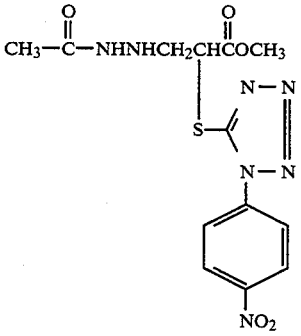
R-14
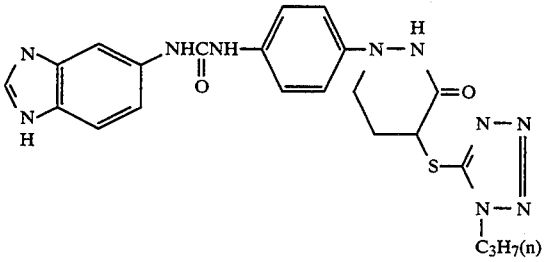

-continued
R-15
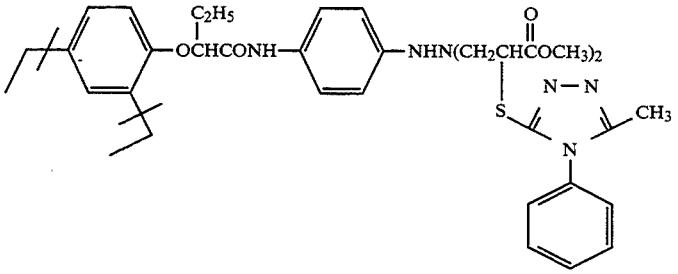
R-16
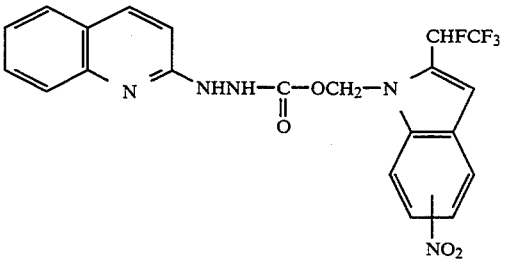
R-17
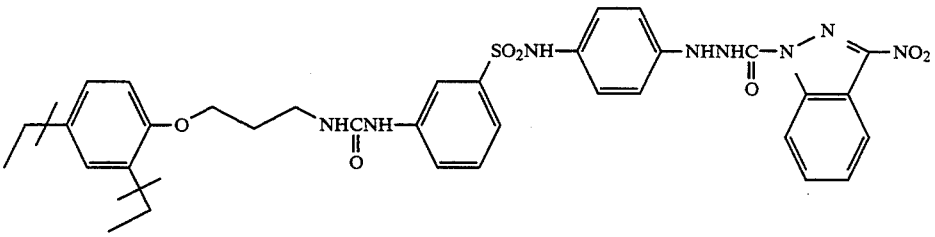
R-18
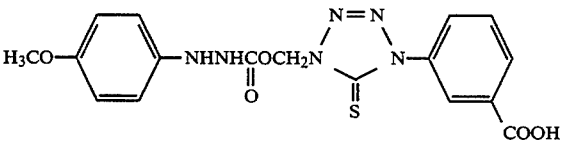
R-19
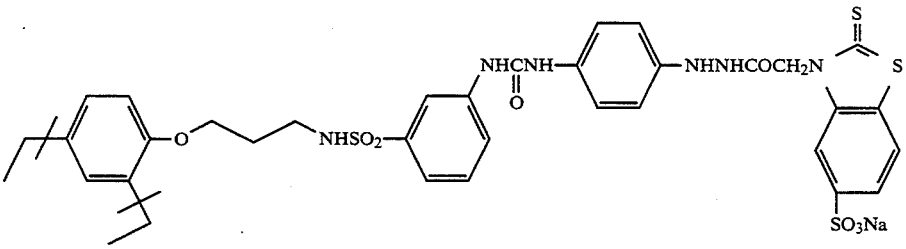
R-20
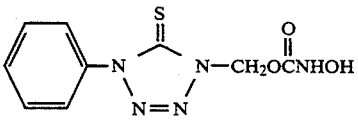
R-21
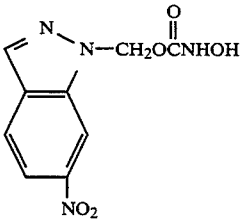

-continued
R-22
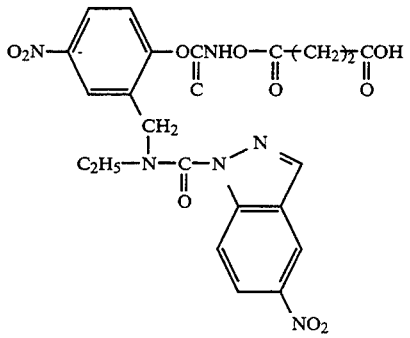
R-23
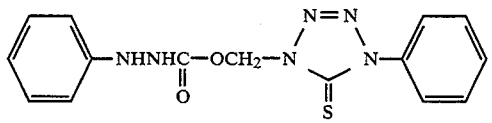
R-24
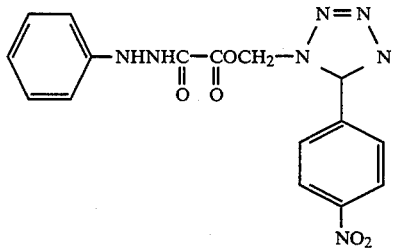
R-25
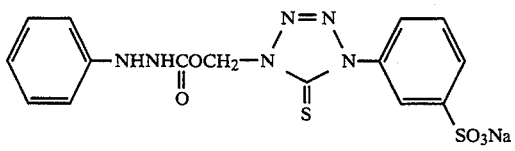
R-26
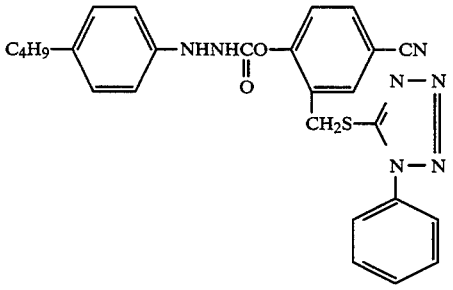
R-27
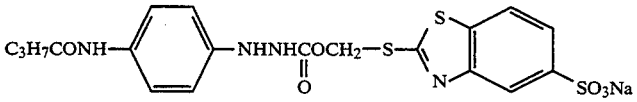
R-28
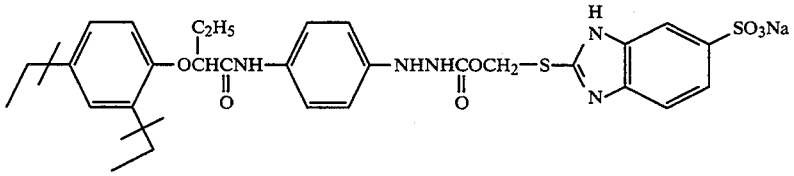

-continued
R-29
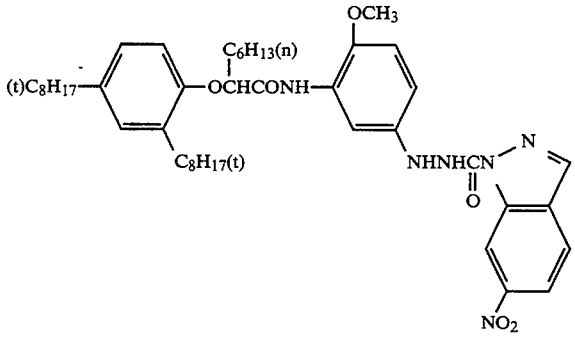
R-30
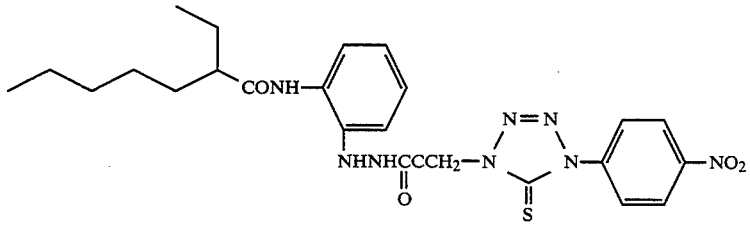
R-31
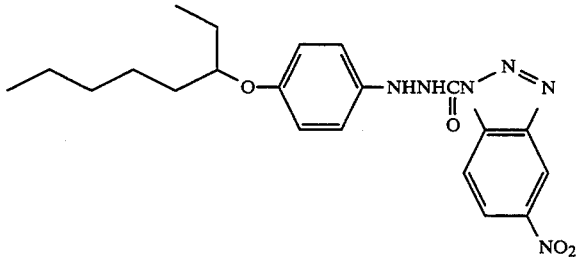
R-32
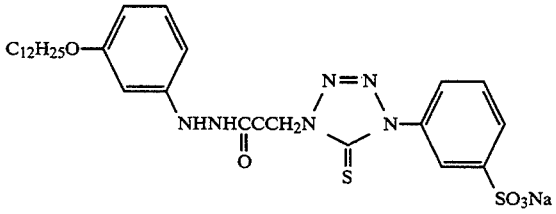
R-33
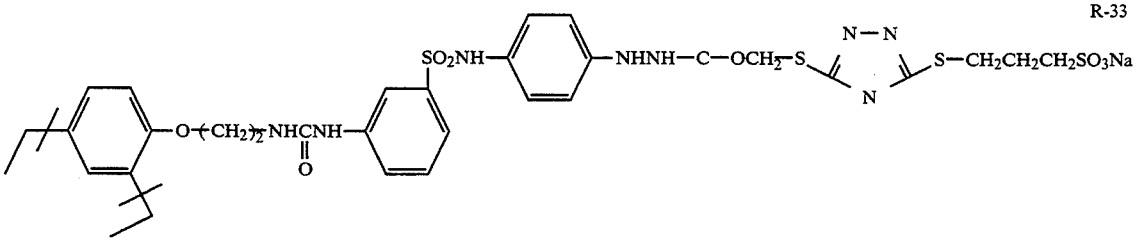
R-34
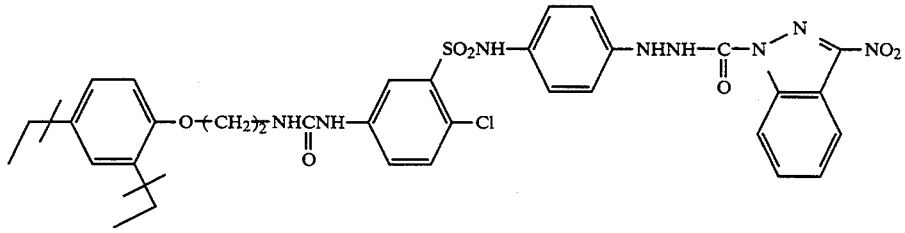

-continued
R-35
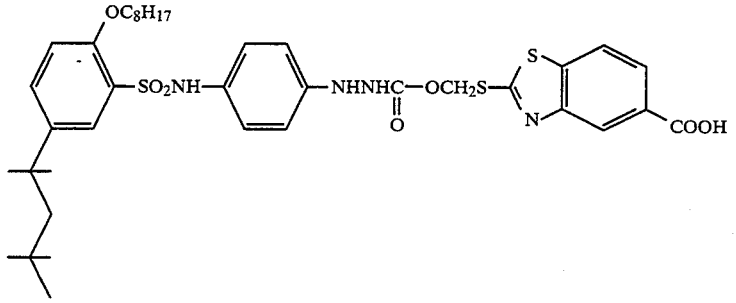
R-36
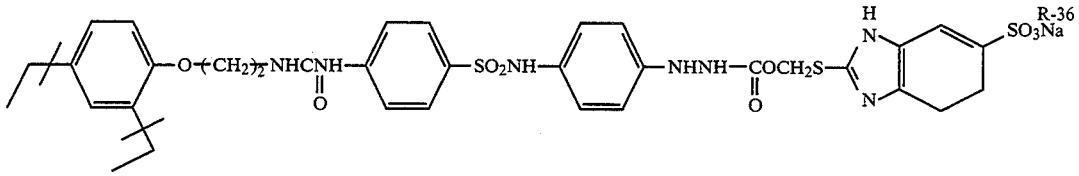
R-37
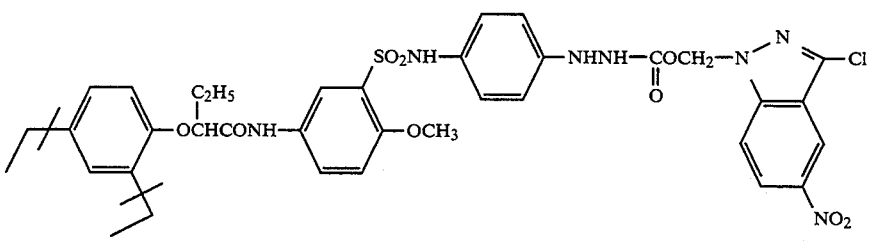
R-38
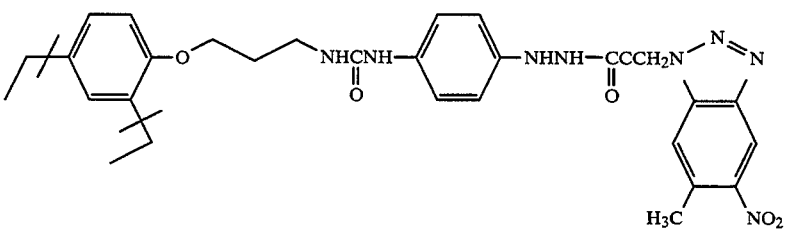
R-39
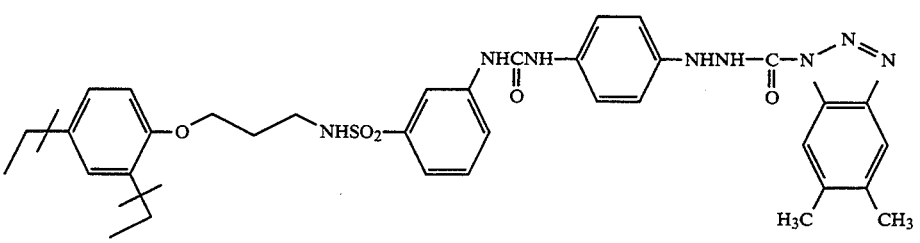
R-40
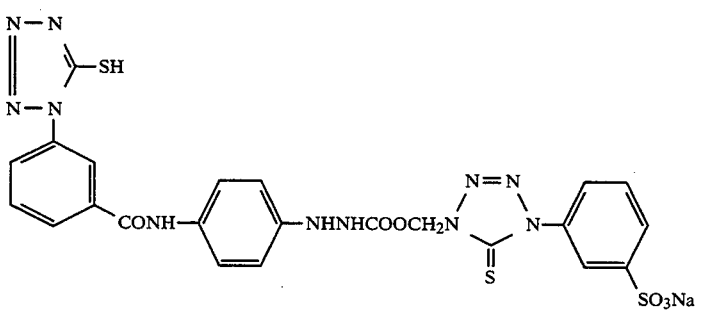

-continued
R-41
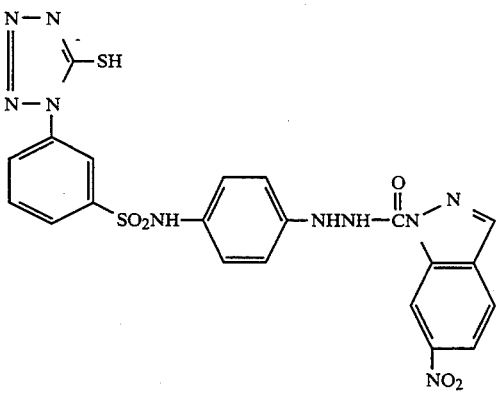
R-42
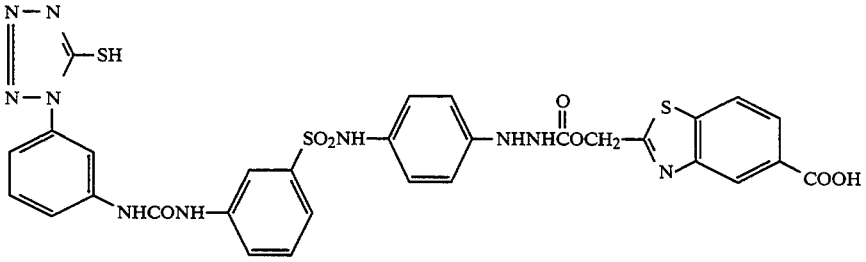
R-43
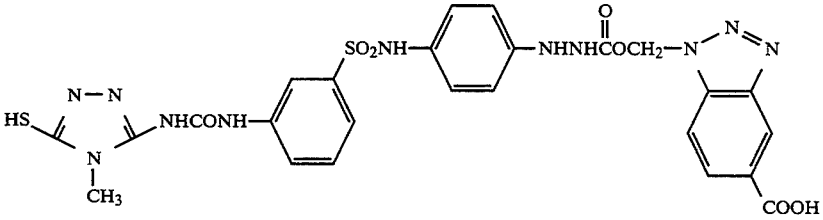
R-44
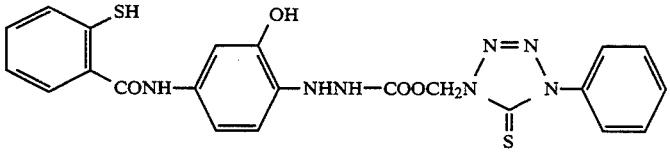
R-45
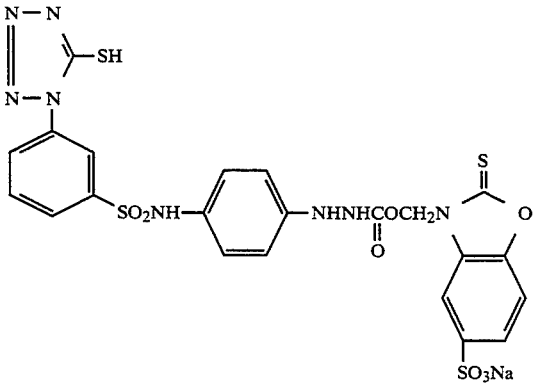

-continued
R-46
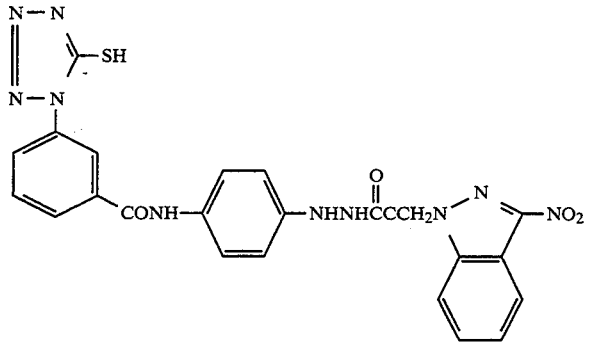
R-47
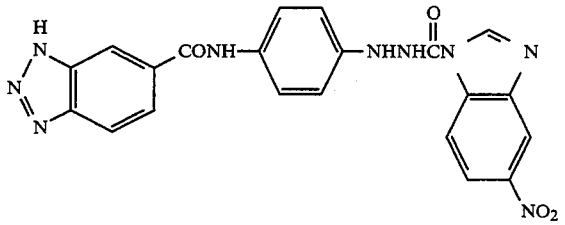
R-48
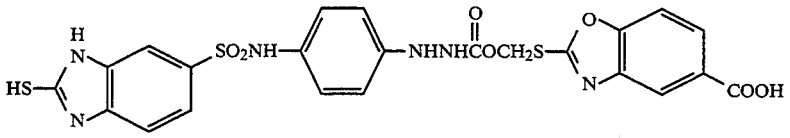
R-49
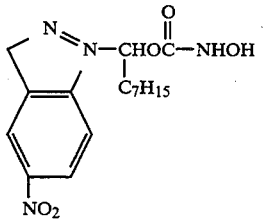
R-50
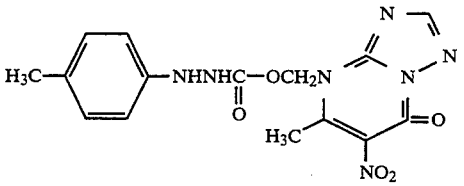
R-51
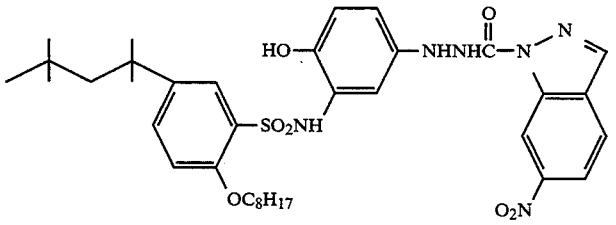
R-52
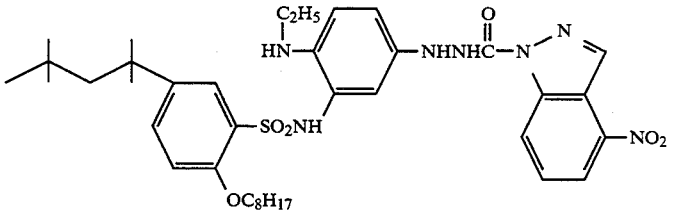

-continued
R-53
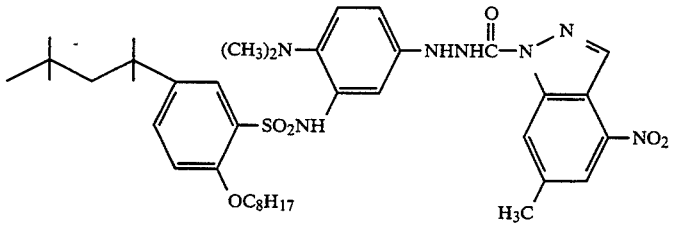
R-54
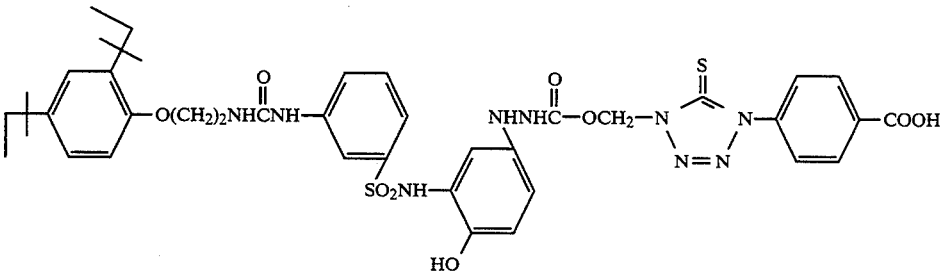
R-55
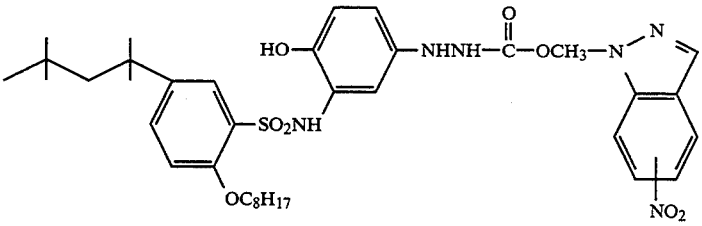
R-56
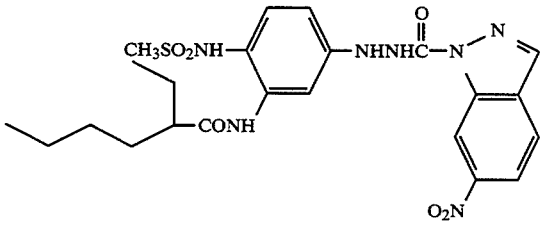
R-57
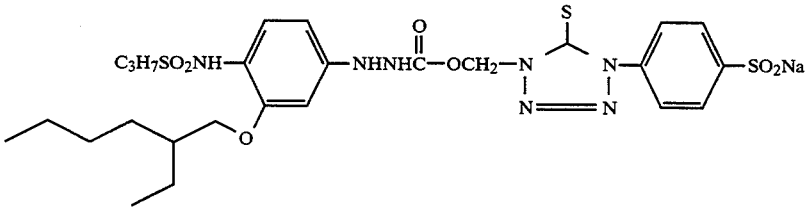
R-58
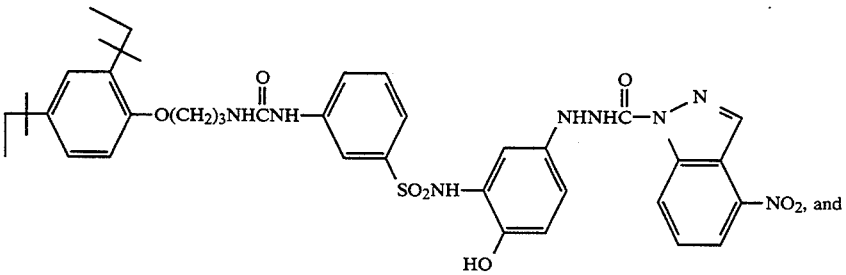

-continued
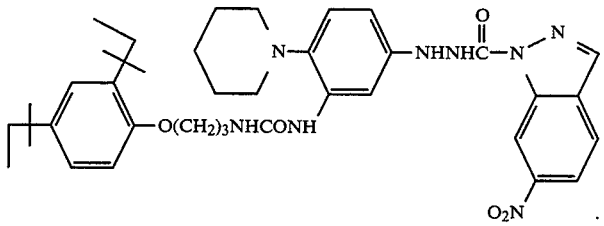
R-59
* * * * *